US012715724B2

(12) United States Patent
Iida

(10) Patent No.: US 12,715,724 B2
(45) Date of Patent: Aug. 25, 2026

(54) SHEET CONVEYING DEVICE, AUTOMATIC DOCUMENT FEEDER, AND IMAGE FORMING APPARATUS

(71) Applicant: Yosuke Iida, Kanagawa (JP)

(72) Inventor: Yosuke Iida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 18/432,004

(22) Filed: Feb. 4, 2024

(65) Prior Publication Data

US 2024/0300760 A1 Sep. 12, 2024

(30) Foreign Application Priority Data

Mar. 9, 2023 (JP) ..... 2023-036498

(51) Int. Cl.
*B65H 7/06* (2006.01)

(52) U.S. Cl.
CPC ..... *B65H 7/06* (2013.01); *B65H 2301/5161* (2013.01); *B65H 2511/12* (2013.01); *B65H 2553/30* (2013.01); *B65H 2553/81* (2013.01)

(58) Field of Classification Search
CPC ..... G03G 2215/00637; B65H 7/06; B65H 2301/5161; B65H 2511/12; B65H 2511/528; B65H 2553/30; B65H 2553/81; B65H 2515/82
USPC ..... 270/52.15, 58.03
See application file for complete search history.

(56) References Cited

U.S. PATENT DOCUMENTS 7,502,570 B2 * 3/2009 Nishimura ..... H04N 1/0005 399/9
8,827,267 B2 * 9/2014 Hongo ..... B65H 3/0653 399/21
8,840,107 B2 * 9/2014 Umi ..... B65H 5/00 271/265.01
8,864,130 B2 * 10/2014 Umi ..... H04N 1/00771 399/21
8,864,131 B2 * 10/2014 Hongo ..... B65H 3/063 399/21
8,870,181 B2 * 10/2014 Morikawa ..... B65H 1/02 271/169
8,894,063 B2 * 11/2014 Araaki ..... B65H 1/00 271/145
8,925,920 B2 * 1/2015 Umi ..... B65H 5/00 271/258.02
9,938,100 B2 * 4/2018 Link ..... B65H 7/06
10,234,808 B2 * 3/2019 Ishihara ..... G03G 15/6541
11,360,420 B2 * 6/2022 Hara ..... G03G 15/5008
(Continued)

FOREIGN PATENT DOCUMENTS

JP 2014-043306 A 3/2014
JP 2015-041858 A 3/2015
JP 2021-181376 A 11/2021
(Continued)

*Primary Examiner* — Leslie A Nicholson, III
(74) *Attorney, Agent, or Firm* — Duft & Bornsen, PC

(57) ABSTRACT

A sheet conveying device includes: a conveyor to convey a sheet in a conveyance direction; a sound collector to collect sound generated by a conveyance of the sheet by the conveyor, the sound collector movable in a sheet width direction orthogonal to the conveyance direction; and a circuitry configured to determine whether an abnormal conveyance occurs based on the sound collected by the sound collector.

10 Claims, 12 Drawing Sheets

(56) References Cited

U.S. PATENT DOCUMENTS

2021/0039900 A1 2/2021 Shimazu et al.

FOREIGN PATENT DOCUMENTS

JP 2023-042119 A 3/2023
JP 2023-158576 A 10/2023

* cited by examiner

SHEET CONVEYING DEVICE, AUTOMATIC DOCUMENT FEEDER, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2023-036498, filed on Mar. 9, 2023, in the Japan Patent Office, the entire disclosure of which is hereby incorporated by reference herein.

TECHNICAL FIELD

The present embodiments relate to a sheet conveying device, an automatic document feeder, and an image forming apparatus.

BACKGROUND ART

A sheet conveying device includes a conveyor to convey a sheet, a sound collector to collect sound generated when the sheet is conveyed, an abnormal conveyance determination unit to determine whether an abnormal conveyance occurs based on the sound collected by the sound collector.

A sound collector is provided on a side fence and the sound collector is movable in a sheet width direction. The sound collector is provided on the side fence, and sound generated when a bundle of one-side bound sheets bound by stapling at any of the four corners of the sheet becomes a paper jam can be collected.

SUMMARY

According to an aspect of the present disclosure, a sheet conveying device includes: a conveyor to convey a sheet in a conveyance direction; a sound collector to collect sound generated by a conveyance of the sheet by the conveyor, the sound collector movable in a sheet width direction orthogonal to the conveyance direction; and a circuitry configured to determine whether an abnormal conveyance occurs based on the sound collected by the sound collector.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
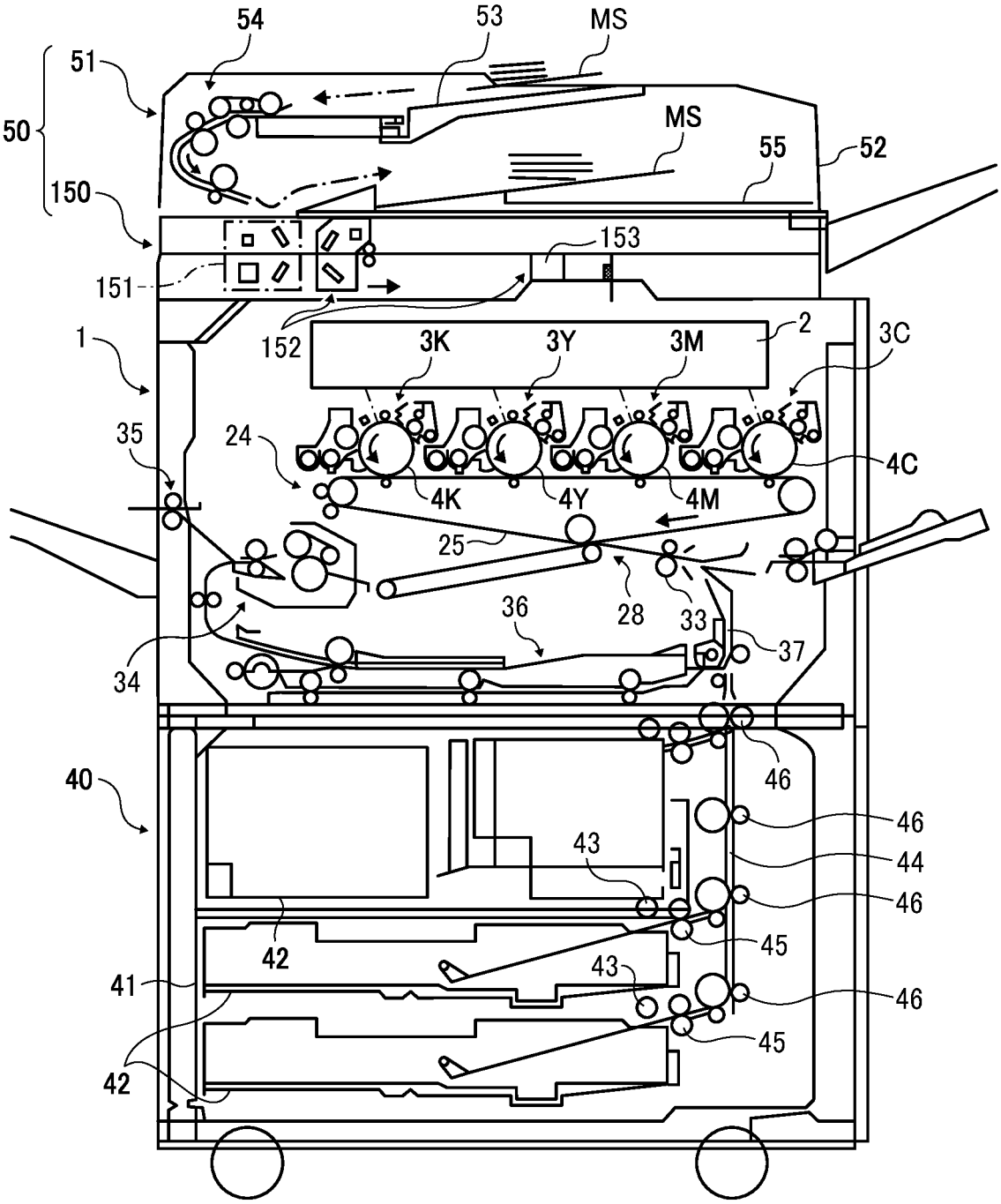
FIG. 1 is a schematic configuration view illustrating a copier according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF EMBODIMENT

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Below, the best mode for carrying out the present embodiment will be described based on the drawings. It is to be understood that those skilled in the art can easily modify and change the present embodiment within the scope of the appended claims to form other embodiments, and these modifications and changes are included in the scope of the appended claims. The following description is an example of the best mode of the present disclosure, and does not limit the scope of the claims.

Hereinafter, an embodiment in which the present embodiment is applied to an electrophotographic copying machine (hereinafter simply referred to as a copier), which is an image forming apparatus, will be described.

A description is now given of the basic configuration of a copier according to the embodiment. FIG. 1 is a schematic configuration view illustrating the copier according to the embodiment. The copier includes an image forming device 1, a blank sheet feeding device 40, and an original document reading device 50. The original document reading device 50 includes a scanner 150 fixedly mounted on the image forming device 1 and an automatic document feeder (ADF) 51 serving as a document feeder supported by the scanner 150.

The blank sheet feeding device 40 includes two paper feed cassettes 42 arranged in a plurality of stages within the paper bank 41, a feed roller 43 that sends out the transfer sheet from the paper feed cassette 42, a separation roller 45 that separates the fed transfer sheet and supplies the separated transfer sheet to the sheet feeding passage 44, and the like. The blank sheet feeding device 40 further includes a plurality of conveyance rollers 46 each of which conveys the transfer sheet toward a sheet feeding passage 37 of the image forming device 1. Thus, the blank sheet feeding device 40 feeds the transfer sheet in the paper feed cassette to the sheet feeding passage 37 in the image forming device 1.

Figure 2:
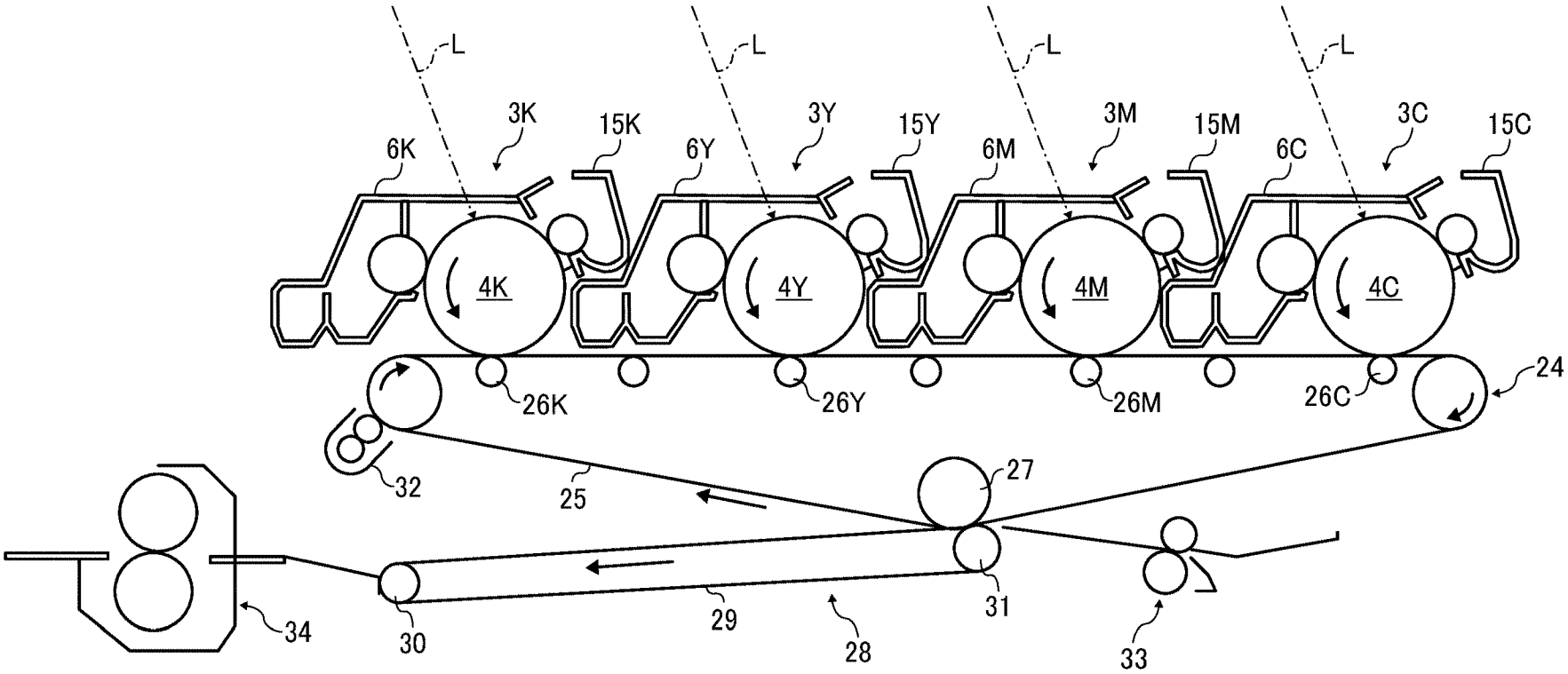
FIG. 2 is a partially enlarged configuration view illustrating an enlarged part of an inner configuration of an image forming device.

FIG. 2 is a partially enlarged configuration view illustrating an enlarged part of an inner configuration of an image forming device 1. The image forming device 1 as an image forming unit includes an optical writing device 2, four process units 3K, Y, M, and C that form toner images of K, Y, M, and C colors, and a transfer unit 24. The image forming device 1 further includes a sheet conveyance unit 28, a registration roller pair 33, a fixing device 34, a switchback device 36, and the sheet feeding passage 37. Then, a light source such as a laser diode or an LED arranged in the optical writing device 2 is driven to irradiate the four drum-shaped photoconductors 4K, Y, M, and C with laser light L. Due to this irradiation, electrostatic latent images are formed on the surfaces of the photoconductors 4K, Y, M, and C, which will be developed to visible toner images via a predetermined development process. Note that the suffixes K, Y, M, and C added after the symbols indicate specifications for black, yellow, magenta, and cyan.

Each of the process units 3K, Y, M, and C supports the photoconductor 4 and various devices arranged around the photoconductor 4 as one unit on a common support. The process units 3K, Y, M, and C are each removably attachable to the main body of the image forming device. Taking the black process unit 3K as an example, the black process unit 3K includes a photoconductor 4K and a developing device 6K for developing an electrostatic latent image formed on the surface of the photoconductor 4K into a black toner image. The black process unit 3K also includes a drum cleaning device 15 that cleans transfer residual toner adhering to the surface of the photoconductor 4K after passing through a primary transfer nip for K, which will be described later. The present copier has a so-called tandem configuration in which four process units 3K, Y, M, and C are aligned side by side opposite to an intermediate transfer belt 25, which will be described later, along its endless movement direction.

Figure 3:
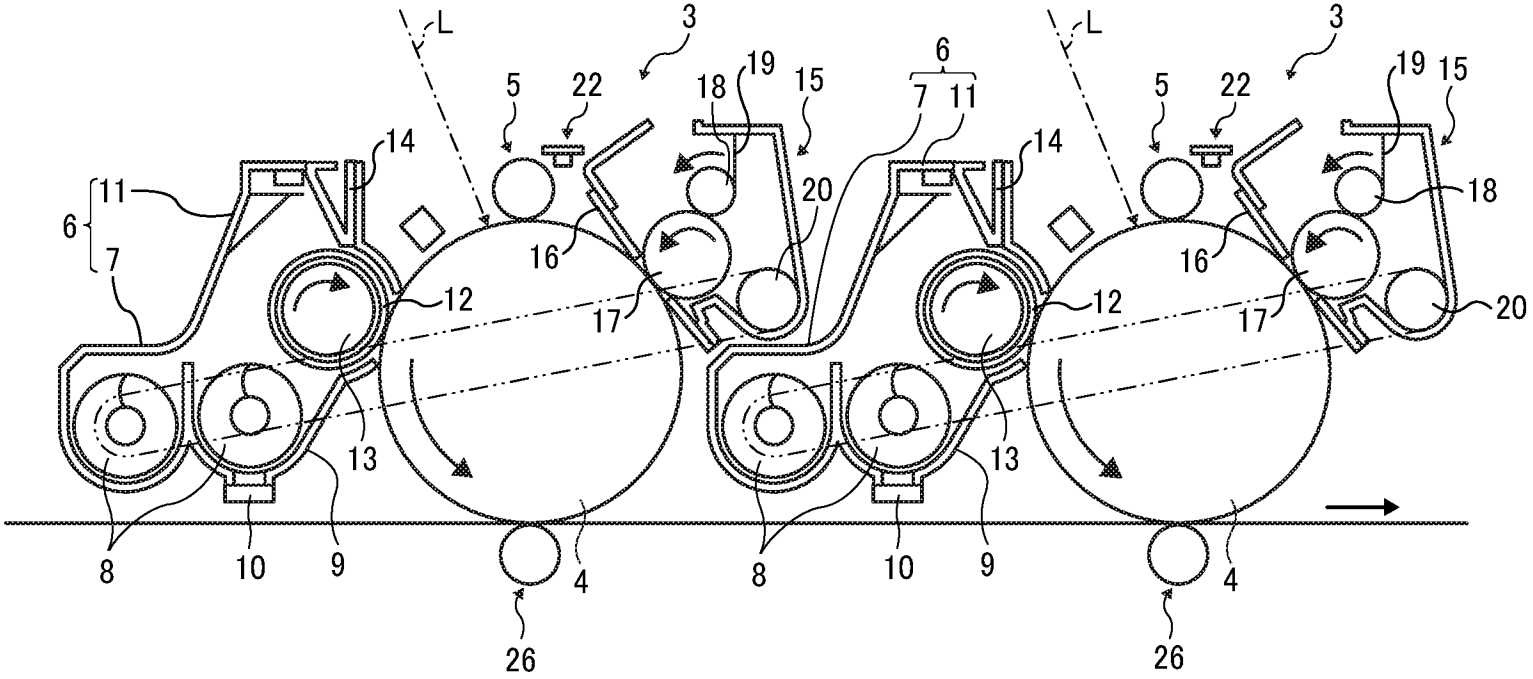
FIG. 3 is a partially enlarged view illustrating a part of a tandem portion including four process units.

FIG. 3 is a partially enlarged view illustrating a part of a tandem portion including four process units 3K, Y, M, and C. Since the four process units 3K, Y, M, and C have substantially the same configuration except that the colors of the toners to be used are different, subscripts K, Y, M, and C attached to the symbols are omitted in the drawing. As illustrated in the drawing, the process unit 3 includes a charging device 5, a developing device 6, a drum cleaning device 15, an electric discharging lamp 22, and the like, around the photoconductor 4.

As the photoconductor 4, a drum-shaped member is used, in which a photosensitive layer is formed by coating a photosensitive organic photosensitive material on a raw tube made of aluminum or the like. Note that the photoconductor 4 may have a shape of endless belt.

The developing device 6 develops an electrostatic latent image into a visible toner image by a two-component developer including magnetic carrier particles and non-magnetic toner. The developing device 6 includes an agitating portion 7 and a development portion 11. The agitating portion 7 stirs the two-component developer accommodated therein and conveys the two-component developer to a developing sleeve 12. The development portion 11 supplies the non-magnetic toner, which is included in the two-component developer and held by the developing sleeve 12, to the photoconductor 4.

The agitating portion 7 is located at a position lower than the development portion 11 and includes two transfer screws 8, a partition, and a toner concentration sensor 10. The two transfer screws 8 are provided in parallel to each other. The partition is provided between the two transfer screws 8. The toner concentration sensor 10 is arranged on the bottom of the development case 9.

The development portion 11 includes the developing sleeve 12, a magnetic roller 13, and a doctor blade 14. The developing sleeve 12 faces the photoconductor 4 through the opening (or the slot) of the development case 9. The magnetic roller 13 is not rotatably disposed inside the developing sleeve 12. The doctor blade 14 is disposed adjacent to the developing sleeve 12 and the leading end of the doctor blade 14 is disposed close to the developing sleeve 12. The developing sleeve 12 has a non-magnetic, rotatable tubular body. The magnetic roller 13 has a plurality of magnetic poles aligned in the order in a rotation direction of the developing sleeve 12, starting from an opposed position to the doctor blade 14. Each of these magnetic poles applies a magnetic force at a predetermined position in the rotation direction of the developing sleeve 12, with respect to the two-component developer supplied on the developing sleeve 12. With this action of the magnetic roller 13, the two-component developer that is conveyed from the agitating portion 7 is attracted and attached to the surface of the developing sleeve 12 and a magnetic brush of toner is formed along the lines of the magnetic force on the surface of the developing sleeve 12.

In accordance with rotation of the developing sleeve 12, the magnetic brush is regulated to have an appropriate layer thickness when passing by the opposed position to the doctor blade 14. Then, the magnetic brush is moved to a development region facing the photoconductor 4. Due to a difference of potentials between a development bias that is applied to the developing sleeve 12 and an electrostatic latent image on the photoconductor 4, the toner is transferred onto the electrostatic latent image, so that the electrostatic latent image is developed into a visible toner image. Further, after returning into the development portion 11 again along the rotation of the developing sleeve 12 then leaving from the surface of the developing sleeve 12 due to repulsion of the magnetic field formed between the magnetic poles of the magnetic roller 13, the two-component developer in a form of the magnetic brush is returned to the agitating portion 7. An appropriate amount of toner is supplied to the two-component developer in the agitating portion 7 based on a result or results detected by the toner concentration sensor 10. Alternative to the two-component developer, the developing device 6 according to the present embodiment may employ one-component developer that does not include magnetic carriers.

In the present embodiment, the drum cleaning device 15 employs a method of pressing a cleaning blade 16 made of a polyurethane rubber pressed against the photoconductor 4. However, in some embodiments, any other suitable cleaning method may be used.

A fur brush 17 according to the present embodiment is provided in order to increase cleanability. The fur brush 17 is a conductive member and the outer peripheral surface of the fur brush 17 slidably contacts the photoconductor 4. The fur brush 17 according to the present embodiment is rotatable in a direction indicated by arrow in the drawing. The fur brush 17 also functions as an applier that scrapes a solid lubricant to obtain fine powder of lubricant and applies the scraped fine powder to the surface of the photoconductor 4. The electric field roller 18 is a metallic member that applies a bias to the fur brush 17. The electric field roller 18 is provided rotatably in a direction indicated by arrow in the drawing. The scraper 19 has a leading end that is pressed against the electric field roller 18. The toner attached to the fur brush 17 is transferred onto the electric field roller 18 that contacts the fur brush 17 in a counter direction to be applied with a bias while the electric field roller 18 is rotating. After being scraped and removed from the electric field roller 18 by the scraper 19, the toner falls onto the collection screw 20. The collection screw 20 conveys the collected toner toward an end portion of the drum cleaning device 15 in a direction perpendicular to the drawing sheet, and delivers the collected toner to an external recycling transfer device. The recycling transfer device 21 sends the delivered toner to the developing device 6 for recycling.

The electric discharging lamp 22 electrically discharges the photoconductor 4 by photo irradiation. The electrically discharged surface of the photoconductor 4 is uniformly charged by the charging device 5 again and then processed for optical writing by the optical writing device 2. As the charging device 5, a charging device is used in which a charging roller to which a charging bias is applied is rotated while contacting the photoconductor 4. However, in some embodiments, the charging device 5 may be a scorotron charger that performs a charging process on the photoconductor 4 in non-contact with the photoconductor 4.

In FIG. 2 illustrated above, K, Y, M, and C toner images are formed on the photoconductors 4K, Y, M, and C of the four process units 3K, Y, M, and C by the processes described above.

The transfer unit 24 is arranged below the process units 3K, Y, M, and C, as illustrated in FIG. 2. The transfer unit 24 endlessly moves the intermediate transfer belt 25 in the clockwise direction in the drawing while the intermediate transfer belt 25 is stretched by a plurality of rollers and contacts the photoconductors 4K, Y, M, and C. By so doing, respective primary transfer nips for K, Y, M, and C are formed between the photoconductors 4K, Y, M, and C and the intermediate transfer belt 25 in contact with each other. In proximity to each of the primary transfer nips for K, Y, M, and C, the primary transfer rollers 26K, Y, M, and C are arranged in contact with the inner loop of the intermediate transfer belt 25 to press the intermediate transfer belt 25 against the photoconductors 4K, Y, M, and C, respectively. A power source applies the primary transfer bias to the primary transfer rollers 26K, Y, M, and C. As a result, respective primary transfer electric fields are generated in the primary transfer nips for K, Y, M, and C to electrostatically transfer respective toner images formed on the photoconductors 4K, Y, M, and C onto the intermediate transfer belt 25. As the intermediate transfer belt 25 passes through the primary transfer nips for K, Y, M, and C along the endless movement in the clockwise direction in the drawing, the toner images are sequentially transferred at respective primary transfer nips and overlaid onto a front surface of the intermediate transfer belt 25. Due to the overlaid primary transfer of the toner images, a four-color overlaid toner image (hereinafter referred to as a four-color toner image) is formed on the outer circumferential surface of the intermediate transfer belt 25.

Below the transfer unit 24 in the drawing is a sheet conveyance unit 28, in which an endless sheet conveyance belt 29 is hung between a drive roller 30 and a secondary transfer roller 31 and moved endlessly. The intermediate transfer belt 25 and the sheet conveyance belt 29 are sandwiched between the secondary transfer roller 31 and a lower tension roller 27 of the transfer unit 24. With this configuration, a secondary transfer nip, in which the front surface of the intermediate transfer belt 25 and the front surface of the sheet conveyance belt 29 are in contact with each other, is formed. A secondary transfer bias is applied to the secondary transfer roller 31 by a power source. On the other hand, the lower tension roller 27 of the transfer unit 24 is electrically grounded. As a result, a secondary transfer electric field is formed in the secondary transfer nip.

A registration roller pair 33 is arranged on the right side of the secondary transfer nip in the drawing, and sends out the transfer sheet sandwiched between the rollers to the secondary transfer nip at a timing that can be synchronized with the four-color toner image on the intermediate transfer belt 25. In the secondary transfer nip, the four-color toner images on the intermediate transfer belt 25 are collectively secondarily transferred to the transfer sheet due to the influence of the secondary transfer electric field and the nip pressure, and become a full-color image in combination with the white color of the transfer sheet. The transfer sheet having passed through the secondary transfer nip is separated from the intermediate transfer belt 25, and is conveyed to the fixing device 34 along with the endless movement while being held on the front surface of the sheet conveyance belt 29.

The transfer residual toner that has not been transferred to the transfer sheet at the secondary transfer nip adheres to the surface of the intermediate transfer belt 25 that has passed through the secondary transfer nip. The transfer residual toner is scraped and removed from the intermediate transfer belt 25 by a belt cleaning device that contacts the intermediate transfer belt 25.

The transfer sheet is conveyed to the fixing device 34. The fixing device 34 fixes the full-color toner image to the transfer sheet by application of heat and pressure. Then, the transfer sheet is conveyed from the fixing device 34 to the sheet ejection roller pair 35 (see FIG. 1) to be ejected to the outside of the copier.

As illustrated in FIG. 1, the switchback device 36 is arranged below the sheet conveyance unit 28 and the fixing device 34. As a result, the transfer sheet having undergone the image fixing processing on one side is switched along the path of the transfer sheet to the transfer sheet reversing device side by the switching claw, and is reversed and enters the secondary transfer nip again. Then, after the secondary transfer processing and the fixing processing of the image are performed on the other side, the sheet is ejected onto the sheet ejection tray.

The scanner 150 is fixedly mounted on the image forming device 1 and includes a first face fixed reading unit 151 serving as a first face reader, and a movable reading unit 152 serving as a first face reader.

The movable reading unit 152 serving as a first face reader is arranged immediately below a second exposure glass 155 (see FIG. 4) that is fixedly mounted on the upper wall of the casing of the scanner 150, so that the second exposure glass 155 contacts the original document MS. The movable reading unit 152 can move optical components such as a light source and reflection mirrors in left and right directions in FIG. 1. Then, in the process of moving the optical system from the left side to the right side in the drawing, the light emitted from the light source is reflected by the original document MS loaded on the second exposure glass, and then received by the image reading sensor 153 fixed to the scanner body via the plurality of reflection mirrors.

The first face fixed reading unit 151 serving as a first face reader is arranged immediately below a first exposure glass 154 (see FIG. 4) that is fixedly mounted on the upper wall of the casing of the scanner 150, so that the first face fixed reading unit 151 contacts the original document MS. Then, when the original document MS conveyed by the ADF 51 to be described later passes over the first exposure glass, the light emitted from the light source is received by the image reading sensor 153 via the plurality of reflection mirrors while being sequentially reflected on the original document surface. By so doing, a first face of the original document MS is scanned without moving the optical units such as the light source and the reflection mirrors.

The scanner 150 also includes a contact image sensor 95 (see FIG. 5) that reads a second face of the original document MS. The contact image sensor 95 is described below.

Figure 4:
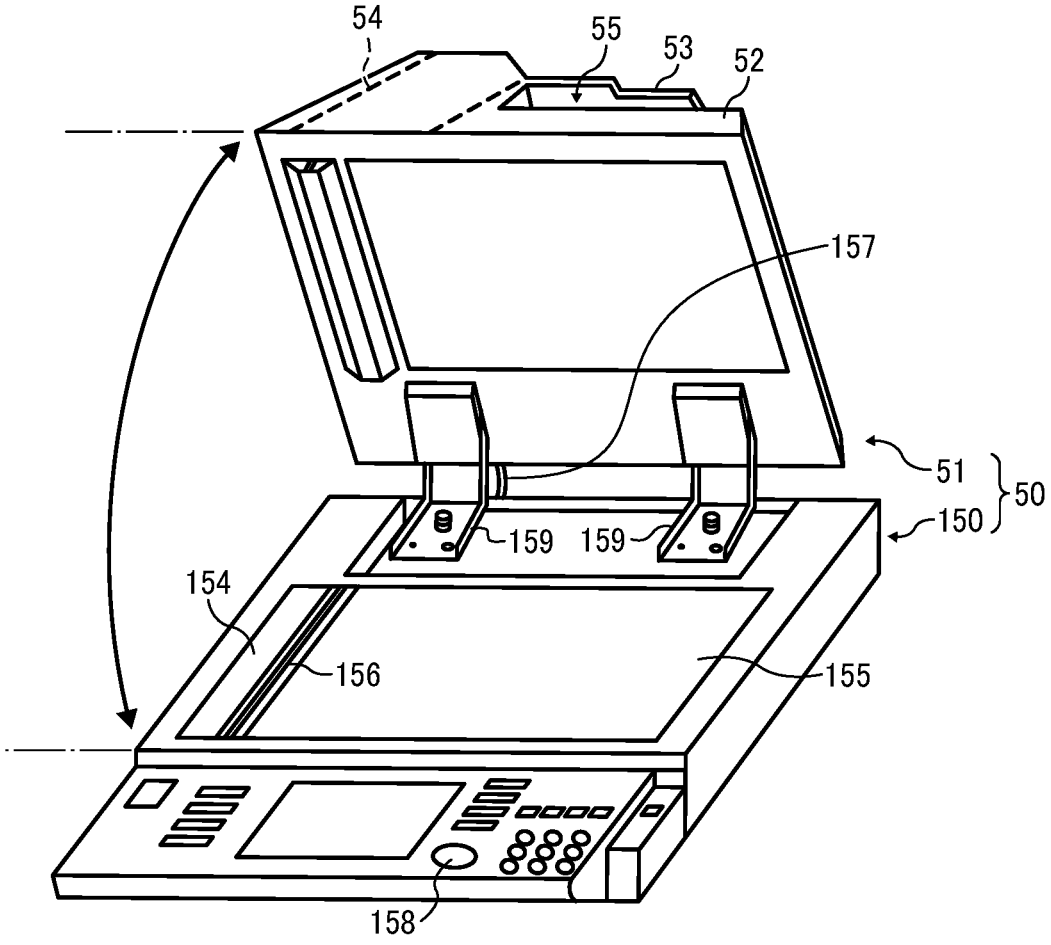
FIG. 4 is a perspective view illustrating a scanner and an automatic document feeder (ADF)

The ADF 51 that is arranged on the scanner 150 includes a body cover 52, an original document loading tray 53, a conveyance unit 54, and an original document stacker 55. The original document loading tray 53 loads the original document MS to be read. The original document conveyance unit 54 conveys the original document MS. The original document stacker 55 receives and stacks the original document MS after the original document MS is read. As illustrated in FIG. 4, hinges 159 each being fixed to the scanner 150 rotatably support the scanner 150 in the upward and downward directions. Then, the first exposure glass 154 and the second exposure glass 155 on the upper surface of the scanner 150 are exposed in an opened state by moving like an opening and closing door by the swing.

In a case of a one-side bound original document such as a book in which one corner of an original document bundle is bound, the original documents MS cannot be separated one by one, and thus the original document MS cannot be conveyed by the ADF 51. Therefore, in the case of the one-side bound original document, after the ADF 51 is opened as illustrated in FIG. 4, the one-side bound original document in which the page to be read is opened is placed on the second exposure glass 155 with the one-side bound original document facing downward, and then the ADF 51 is closed. The movable reading unit 152 indicated in FIG. 1 of the scanner 150 then reads the image of the page.

On the other hand, when the original documents MS are in a form of an original document bundle of simply accumulated individual original documents MS, the original documents MS are automatically conveyed by the ADF 51 one by one. Then, the original documents MS are sequentially read by the first face fixed reading unit 151 in the scanner 150 or the contact image sensor 95 in the ADF 51. In this case, a copy start button is pressed after the original document bundle is set on the original document loading tray 53 of the ADF 51. Then, the ADF 51 starts conveyance of the original document MS that is an original document bundle loaded on the original document loading tray 53 to convey each original document MS sequentially from top to the original document stacker 55. During the conveyance process, immediately after the original document MS is inverted, the original document MS is caused to pass immediately above the first face fixed reading unit 151 of the scanner 150. At this time, an image of the first face of the original document MS is read by the first face fixed reading unit 151 of the scanner 150.

Figure 5:
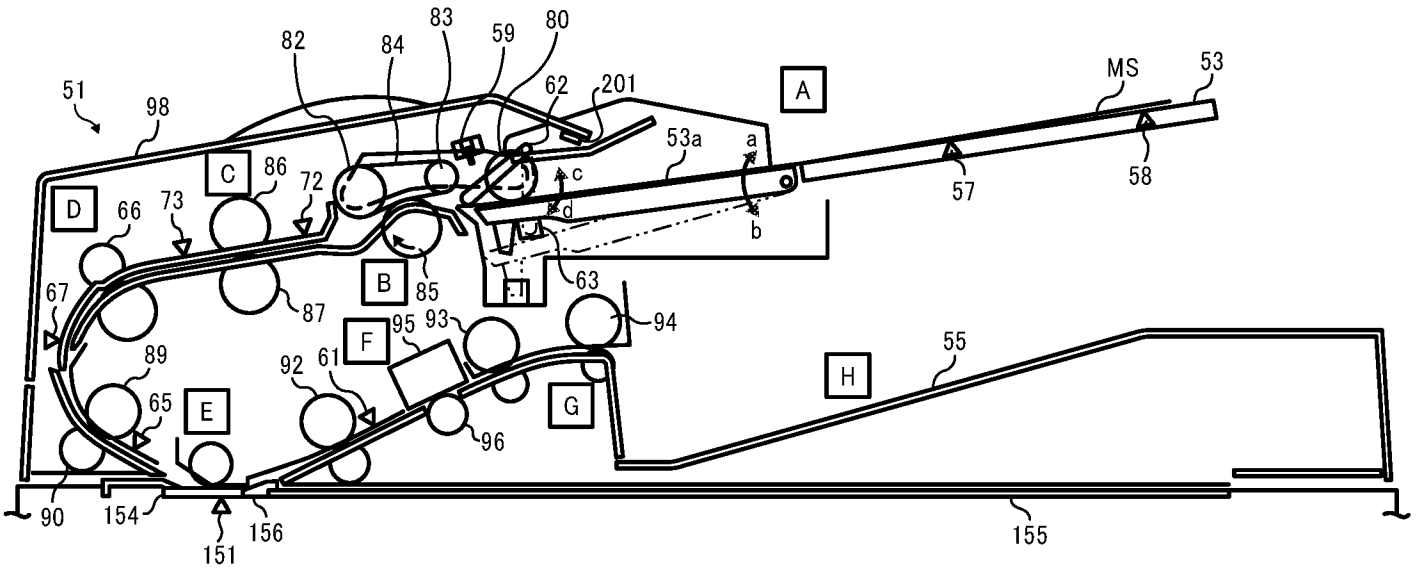
FIG. 5 is an enlarged configuration view illustrating a main part configuration of the ADF together with an upper part of the scanner.
Figure 6:
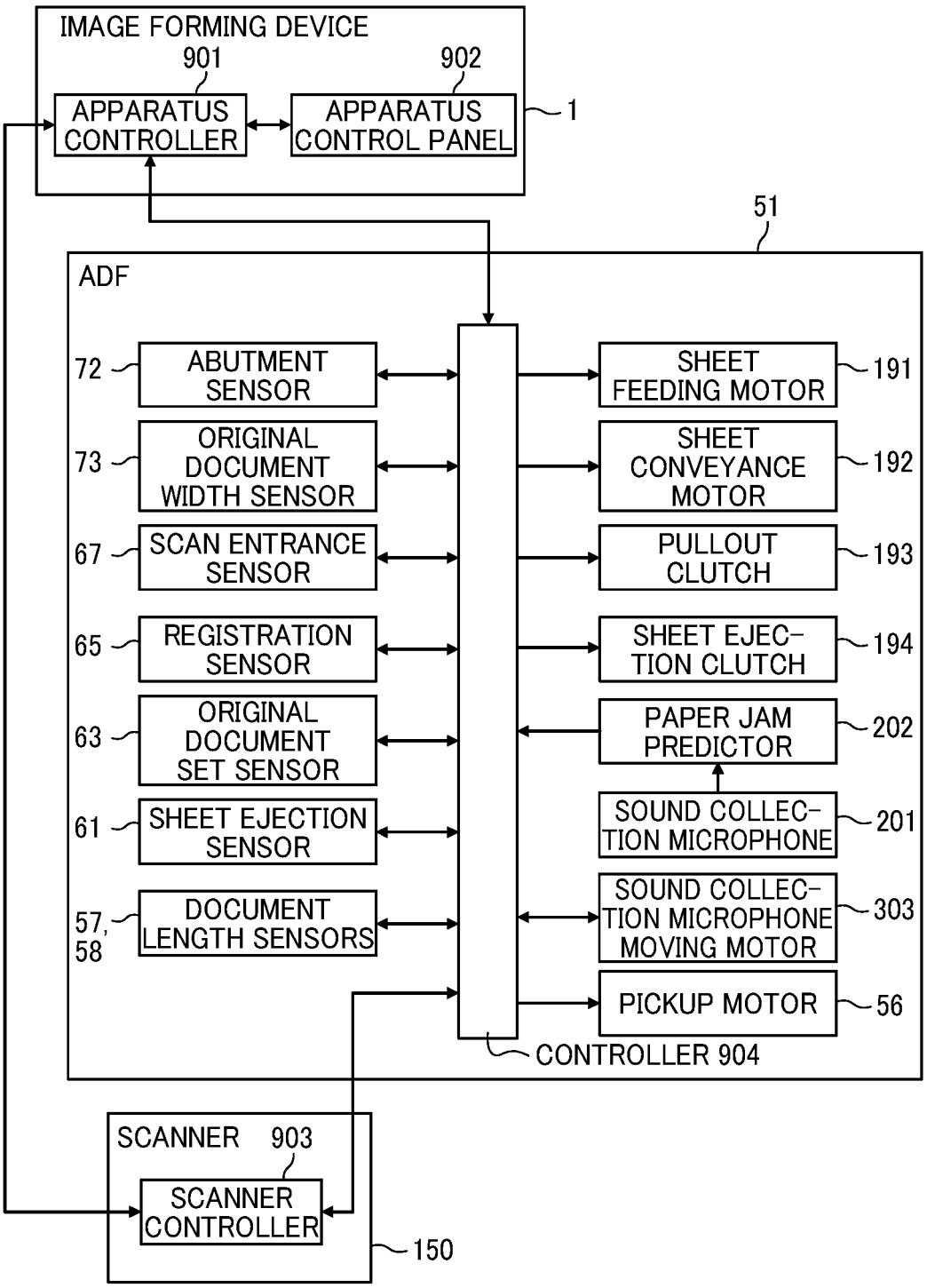
FIG. 6 is a block diagram illustrating parts of electrical circuits of the ADF and scanner.

FIG. 5 is an enlarged configuration view illustrating a main part configuration of the ADF 51 together with an upper part of the scanner 150. FIG. 6 is a block diagram illustrating parts of electrical circuits of the ADF 51 and the scanner 150. As illustrated in FIG. 5, the ADF 51 includes an original document setting part A, an original document separating and feeding part B, a registration part C, a turn part D, a first reading and conveying part E, a second reading and conveying part F, a sheet ejection unit G, a stack unit H, and the like.

As illustrated in FIG. 6, the ADF 51 includes a controller 904 provided with an application specific integrated circuit (ASIC) and the like to control various components and sensors in the ADF 51. The controller 904 is connected to, for example, a registration sensor 65, an original document set sensor 63, a sheet ejection sensor 61, an abutment sensor 72, an original document width sensor 73, a scan entrance sensor 67, and the first length sensor 57 and the second length sensor 58. The controller 904 is further connected to, for example, a sheet feeding motor 191, a conveyance motor 192, a pullout clutch 193, a sheet ejection clutch 194, and a pickup motor 56. The controller 904 is further connected to a sound collection microphone 201 serving as a sound collector. The sound collection microphone 201 collects sound occurring when the original document MS is conveyed. The controller 904 is further connected to a sound collection microphone moving motor 303 and a paper jam predictor 202. The sound collection microphone moving motor 303 moves the sound collection microphone 201 in the width direction of an original document. The paper jam predictor 202 serves as an abnormal conveyance determination unit that predicts (determines) whether a paper jam occurs on the original document based on the sound collected by the sound collection microphone 201.

As illustrated in FIG. 6, the scanner 150 includes a scanner controller 903 including a central processing unit (CPU) and a random access memory (RAM). With the scanner controller 903, various components and sensors in the scanner 150 can be controlled. Further, the scanner controller 903 is connected to the controller 904 of the ADF 51 via the interface (I/F). The scanner controller 903 may indirectly control the various components and sensors in the ADF 51 via the controller 904.

In FIG. 5, the original document setting part A has, for example, the original document loading tray 53 on which a bundle of original documents MS is set. The original document separating and feeding part B separates the original documents MS one by one from the set bundle of original documents MS to feed the separated original document MS. Further, the registration part C temporarily contacts the fed original documents MS and align the original documents MS to send out again. The turn part D has a conveyance unit curved in a C-shape, and turns the original document MS to be conveyed in the curved conveyance unit so as to reverse the original document MS upside down while turning the original document MS. Further, while conveying the original document MS on the first exposure glass 154, the first reading and conveying part E causes the first face fixed reading unit 151 arranged inside the scanner 150 below the first exposure glass 154 to read the first face of the original document MS. Further, while conveying the original document MS under the contact image sensor 95, the second reading and conveying part F causes the contact image sensor 95 to read the second face of the original document MS. Further, the sheet ejection unit G is for discharging the original document MS whose images on both faces have been read toward the stack unit H. Further, the stack unit H stacks the original documents MS on the original document stacker 55.

The original document MS is set with the leading end portion of the original document MS placed on the movable original document table 53*a* serving as a sheet tray pivotable in the directions indicated by arrows "a" and "b" in the drawing depending on the thicknesses of a bundle of original documents MS and the trailing end side of the original document MS placed on the original document loading tray 53. At this time, the side guides of the original document loading tray 53 contact both ends of the original document MS in the width direction (i.e., the direction orthogonal to the drawing sheet) to adjust the position of the original document MS in the width direction. The original documents MS thus set push up a lever 62 that is pivotably arranged above the movable original document table 53*a*. Along with this movement of the original documents MS, the original document set sensor 63 detects the setting of the original documents MS, and transmits the detection signal to the controller 904 (see FIG. 6). The detection signal is then transmitted from the controller 904 to the scanner controller 903 via the I/F.

The original document loading tray 53 holds a first length sensor 57 and a second length sensor 58 each including a reflective photosensor or an actuator-type sensor that detects the length of the original document MS in the conveyance direction. The length of the original document MS in the conveyance direction is detected with the first length sensor 57 and the second length sensor 58.

The pickup roller 80 is supported by the cam mechanism to be movable in the upward and downward directions (i.e., the directions indicated by arrows "c" and "d" in the drawing) and is arranged above the bundle of original documents MS loaded on the movable original document table 53*a*. The cam mechanism is driven by the pickup motor 56 to move the pickup roller 80 in the upward and downward directions. As the pickup roller 80 moves upward, the movable original document table 53*a* rotates in the direction indicated by arrow "a" in the drawing, so that the pickup roller 80 contacts the uppermost original document MS placed on top of the bundle of original documents MS. As the movable original document table 53*a* further moves upward, a table lifting sensor 59 detects that the movable original document table 53*a* moves up to the maximum height. In response to this detection, the pickup motor 56 stops driving to stop the movable original document table 53*a* from moving up.

The apparatus control panel 902 including, for example, a numeric keypad and a display provided on the main body of the copier is operated by an operator to perform a key operation for setting a reading mode indicating a double-sided reading mode or a single-sided reading mode and a pressing operation of a copy start key. In other words, the apparatus control panel 902 functions as a mode information acquisition unit that acquires information indicating whether the reading mode is the double-sided reading mode or the single-sided reading mode. The reading mode includes a thin paper mode for reading thin paper and a mixed mode in which original documents MS of different sizes are mixed and conveyed. The operator can set the thin paper mode or the mixed mode by the key operation on the apparatus control panel 902. In the thin paper mode or the mixed mode, the original document MS is conveyed at a conveyance speed of the original document MS totally slower than the normal reading mode.

As the copy start button is pressed down, an original document sheet feeding signal is sent from an apparatus controller 901 to the controller 904 of the ADF 51 via the I/F. In response to the sending of the original document feeding signal, the pickup roller 80 is rotated along with the forward rotation of the sheet feeding motor 191, so that the original documents MS on the movable original document table 53*a* are sent out from the movable original document table 53*a*.

When setting the double-sided reading mode or the single-sided reading mode, it is possible to set double-sided or single-sided for all original documents MS loaded on the movable original document table 53*a* at once.

In addition, it is also possible to individually set the reading mode for each of the individual documents MS, such as setting the double-sided reading mode for the first and the tenth documents MS and setting the single-sided reading mode for the other documents MS.

The original document MS sent out by the pickup roller 80 enters the original document separating and feeding part B to be fed to the contact position with the sheet feed belt 84. The sheet feed belt 84 is stretched by a drive roller 82 and a driven roller 83 to be endlessly moved in the clockwise direction in the drawing by rotation of the drive roller 82 along with the forward rotation of the sheet feeding motor 191. A separation roller 85 contacts the lower stretched face of the sheet feed belt 84 to be rotated in the clockwise direction in the drawing along with the forward rotation of the sheet feeding motor 191. At the contact part, the surface of the sheet feed belt 84 moves in the sheet feeding direction.

On the other hand, the separation roller 85 contacts the sheet feed belt 84 at a predetermined pressure, and co-rotates with the belt or the original document MS when being in direct contact with the sheet feed belt 84 or when only one original document MS is nipped by the contact part. However, when a plurality of original documents MS is nipped in the contact part, the force of the separation roller 85 to be rotated with rotation of the sheet feed belt 84 or movement of the original document MS is lower than the torque of a torque limiter. For this reason, the separation roller 85 is rotated in the clockwise direction in the drawing that is opposite to a direction in which the separation roller 85 is rotated. As a result, the separation roller 85 applies the moving force in the direction opposite to the sheet feeding direction, to the original documents MS under the uppermost original document MS, so that the uppermost original document MS is separated from the plurality of original documents MS under the uppermost original document MS.

The original document MS separated into one sheet by the action of the sheet feed belt 84 and the separation roller 85 enters the registration part C. Then, the leading end of the original document MS is detected when the original document MS passes directly under the abutment sensor 72. At this time, the pickup roller 80 receiving the driving force of the sheet feeding motor 191 is still rotating. However, as the pickup roller 80 is separated from the original document MS due to descending of the movable original document table 53*a*, the original document MS is conveyed only by an endless moving force of the sheet feed belt 84. Then, the endless movement of the sheet feed belt 84 is continued for a predetermined time from the timing at which the leading end of the original document MS is detected by the abutment sensor 72. Then, the leading end of the original document MS contacts the contact part of the pullout driven roller 86 and the pullout drive roller 87 that rotates while contacting the pullout driven roller 86. While the leading end of the original document MS contacts the contact part of the pullout driven roller 86 and the pullout drive roller 87, the trailing end of the original document MS is conveyed in the sheet feeding direction. By so doing, the leading end of the original document MS is positioned at the contact part while the original document MS is bent by a predetermined amount. Accordingly, skew (inclination) of an original document MS is corrected, and the original document MS is positioned correctly in the sheet feeding direction.

The pullout drive roller 87 has a function of correcting skew of the original document MS, and further has a function of conveying the original document MS after skew correction to an intermediate roller pair 66 disposed downstream from the pullout drive roller 87 in the conveyance direction. The drive roller 82, the pullout drive roller 87, and the drive roller of the intermediate roller pair 66 winding and stretching the pickup roller 80 and the sheet feed belt 84 are coupled to the sheet feeding motor 191 via respective one-way clutches. The one-way clutches coupled to the pullout drive roller 87 and the drive roller of the intermediate roller pair 66 transmit the driving force when the sheet feeding motor 191 rotates in the reverse direction. The one-way clutch coupled to the drive roller 82 transmits the driving force when the sheet feeding motor 191 rotates in the forward direction. For this reason, when the sheet feeding motor 191 rotates in the reverse direction, the pullout drive roller 87 and the drive roller of the intermediate roller pair 66 start rotating and the endless movement of the sheet feed belt 84 stops. At this time, the pickup roller 80 stops rotating.

The original document MS sent out by the pullout drive roller 87 passes directly under the original document width sensor 73. The original document width sensor 73 includes a plurality of document detectors each including a reflective photosensor. The plurality of document detectors is aligned in a row in the width direction of the original document MS (i.e., the direction orthogonal to the drawing sheet). The size of the original document MS in the width direction is detected based on which one of the plurality of document detectors detects the original document MS. The length of the original document MS in the conveyance direction is detected based on the time from when the leading end of the original document MS is detected by the abutment sensor 72 to when the trailing end of the original document MS is not detected by the abutment sensor 72.

The leading end of the original document MS whose size in the width direction is detected by the original document width sensor 73 enters the turn part D and is nipped by the contact part between the rollers of the intermediate roller pair 66. The conveyance speed of the original document MS by the intermediate roller pair 66 is set to be higher than the conveyance speed of the original document MS in the first reading and conveying part E described later. As a result, the time until the original document MS is sent to the first reading and conveying part E is shortened.

The leading end of the original document MS conveyed in the turn part D passes through a position where the leading end of the original document MS faces the scan entrance sensor 67. As a result, when the leading end of the original document MS is detected by the scan entrance sensor 67, the original document conveyance speed of the original document MS by the intermediate roller pair 66 is reduced until the leading end of the original document MS is conveyed to the position of the scan entrance roller pair (including rollers 89 and 90) downstream from the scan entrance sensor 67 in the conveyance direction. In addition, with the start of the rotational driving of the conveyance motor 192, one roller in the scan entrance roller pair (89 and 90), one roller in scan exit roller pair 92, and one roller in the second scan exit roller pair 93 start rotational driving, respectively.

In the turn part D, while the original document MS is conveyed in the curved conveyance passage between the intermediate roller pair 66 and the scan entrance roller pair (including the rollers 89 and 90), the upper and lower faces of the original document MS are reversed, and the conveyance direction of the original document MS is turned back. Then, the leading end of the original document MS that has passed through the nip between the rollers (89 and 90) of the scan entrance roller pair passes directly under the registration sensor 65. At this time, when the registration sensor 65 detects the leading end of the original document MS, the conveyance speed of the original document MS is gradually decreased through the predetermined conveyance distance. Then, before the first reading and conveying part E, the conveyance of the original document MS is temporarily stopped. Further, a temporary stop signal is sent to the scanner controller 903 (see FIG. 6) via the I/F.

When the scanner controller 903 that has received the temporary stop signal transmits the reading start signal, the rotation of the conveyance motor 192 is restarted under the control of the controller 904 until the leading end of the original document MS reaches the inside of the first reading and conveying part E, and the conveyance speed of the original document MS is increased to a predetermined conveyance speed. Then, a gate signal indicating the sub-scanning direction effective image region of the first face of the original document MS is transmitted from the controller 904 to the scanner controller 903 at the timing when the leading end of the original document MS reaches the reading position by the first face fixed reading unit 151. This transmission is continued until the trailing end of the original document MS comes out of the reading position by the first face fixed reading unit 151, and the first face of the original document MS is read by the first face fixed reading unit 151. The timing at which the leading end of the original document MS reaches the reading position by the first face fixed reading unit 151 is calculated based on the pulse count of the conveyance motor 192.

The original document MS that has passed through the first reading and conveying part E passes through the scan exit roller pair 92, which will be described below. Then, the leading end of the original document MS is detected by the sheet ejection sensor 61. When the single-sided reading mode is set, it is not necessary to read the second face of the original document MS by the contact image sensor 95 described later. As the leading end of the original document MS is detected by the sheet ejection sensor 61, the driving force of the sheet conveyance motor 192 is connected to the sheet ejection roller pair 94 by the sheet ejection clutch 194 to rotate the lower ejection roller in the drawing of the sheet ejection roller pair 94 in the clockwise direction in the drawing. The timing at which the trailing end of the original document MS passes through the nip of the sheet ejection roller pair 94 is calculated based on the pulse count of the sheet conveyance motor 192 after the detection of the leading end of the original document MS by the sheet ejection sensor 61. Then, based on this calculation result, the driving force of the sheet conveyance motor 192 is cut by the sheet ejection clutch 194 to stop the sheet ejection roller pair 94.

On the other hand, when the double-sided reading mode is set, the sheet ejection sensor 61 initially detects the leading end of the original document MS. Then, the timing at which the original document MS reaches the contact image sensor 95 is calculated based on the pulse count of the sheet conveyance motor 192. Then, at that timing, the controller 904 sends a gate signal indicating the effective image region of the second face of the original document MS in the sub-scanning direction, to the scanner controller 903. This transmission is continued until the trailing end of the original document MS comes out of the reading position by the contact image sensor 95, and the second face of the original document MS is read by the contact image sensor 95.

In the contact image sensor 95 (CIS) serving as a second face reader, the reading face is subjected to coating processing for the purpose of preventing a vertical scanning line due to adhesion of pasty foreign matter adhering to the original document MS to the reading face. A second reading roller 96 serving as an original document supporter that supports the original document MS from the non-reading face side (first face side) is arranged at a position facing the contact image sensor 95. The second reading roller 96 has a role of preventing the original document MS from being lifted at the reading position by the contact image sensor 95 and functioning as a reference white part for acquiring shading data in the contact image sensor 95. In the copier, the second reading roller 96 is used as an original document supporter for supporting the original document MS at a position facing the contact image sensor 95, but a guide plate-like device may also be used.

In addition, a bundle of original documents MS bound by binding tools such as staples and clips may be set on the original document loading tray 53 due to user's carelessness. The binding tool is referred also as a "binder".

As the leading end of the bundle of original documents MS bound by a binding tool enter the separation portion at which the leading end of the bundle of original documents MS contacts the sheet feed belt 84 of the separation roller 85, the uppermost original document MS placed on top of the bundle of original documents MS is continuously conveyed by the sheet feed belt 84.

However, the second and subsequent original documents receive a conveyance force by the separation roller 85 to return the second and subsequent original documents MS to the original document loading tray 53. As a result, the original documents MS are distorted, and folded or wrinkled.

Conventionally, conveyance of a bound bundle of original documents is continued in a state in which folds or wrinkles or the like occur on the original document MS until a sheet paper jam is detected without the abutment sensor 72 detecting the leading end of the original document MS by a predetermined timing. As a result, the wrinkles and the folds of the original document become worse, and a large stress is finally applied to the location bound by the binding tool, resulting in tearing and causing serious damage to the original document MS.

Therefore, in the present embodiment, an abnormal conveyance determination process of determining (prediction of whether sheet paper jam is detected by the abutment sensor 72 and subsequent sensors) whether a sheet paper jam as an abnormal conveyance occurs from the sound during the sheet feeding/separating operation collected by the sound collection microphone 201 is performed by the paper jam predictor 202. Then, when the paper jam predictor 202 determines that a sheet paper jam occurs, the conveyance of the original document MS is stopped. As a result, the conveyance of the original document can be stopped before the sheet paper jam is detected by the abutment sensor 72. As a result, the conveyance of the original document can be stopped before the original document MS is greatly damaged such as torn. In addition, at the time of conveyance stop, the possibility of occurrence of a sheet paper jam may be displayed on the display panel of the apparatus control panel 902, or a warning sound may be emitted from a speaker.

In the present embodiment, the feature of an operation sound generated when the original documents are conveyed is collected by the sound collection microphone 201. The feature amount that quantitatively describes the feature of the operation sound is extracted and abnormal conveyance of the original documents MS is determined by a Mahalanobis-Taguchi (MT) method based on the extracted feature amount. The MT method is one of a Mahalanobis-Taguchi (MT) system known for prediction, diagnosis and analysis based on multidimensional information data in the field of, for example, quality engineering. The MT method is a method that can determine whether the data is normal or abnormal by using the Mahalanobis distance, and is a method that can determine whether the condition is normal or abnormal in a simple manner and with relatively high accuracy. A detailed description of the MT method is omitted as the MT method is a publicly known method described in, for example, Japanese Patent Application Laid-Open No. 2003-141306 or Genichi Taguchi "Mathematics of Quality Engineering" (published by Japanese Standard Association in 1999).

As a determination parameter used for determining an abnormal conveyance, the following data is stored in advance in the non-volatile memory of the paper jam predictor 202. In other words, the data includes an inverse matrix R-1 of the correlation matrix of a unit space data set (i.e., the reference data set) used when calculating the Mahalanobis distance and a threshold Th for classifying the calculated Mahalanobis distance into a normal conveyance or an abnormal conveyance.

The inverse matrix R-1 is obtained by creating a unit space data set (reference data set) based on the feature amount obtained from the operation sound when the original document MS is normally conveyed in advance. The threshold Th for classifying the calculated Mahalanobis distance into a normal conveyance and an abnormal conveyance is set by obtaining in advance a Mahalanobis distance at which a false negative rate (erroneous determination rate of normal conveyance) and a false positive rate (erroneous determination rate of abnormal conveyance) are equal to or less than respective target values.

The sound collection microphone 201 is preferably arranged at a position where a deformation sound of the original document at the time of occurrence of wrinkles or folds of the original document can be preferably picked up as a sound generated at the time of occurrence of a paper jam in the width direction of the original document. An occurrence position and an occurrence manner of deformation such as wrinkles and folds of the original document differ depending on a binding position and a binding method. As a result, the optimum position where the original document deformation sound of the sound collection microphone 201 can be preferably picked up in the width direction of the original document differs depending on the binding position and the binding method.

Figure 7A:
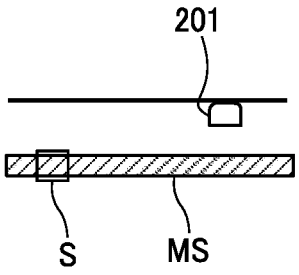
FIGS. 7A, 7B, and 7C are views each illustrating an optimum position of a sound collection microphone.
Figure 7B:
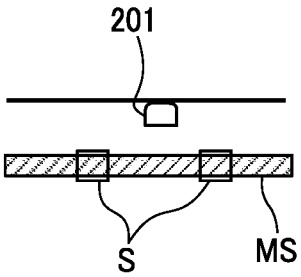
Figure 7C:
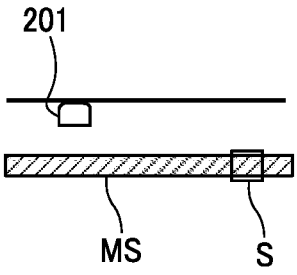

FIGS. 7A, 7B, and 7C are views each illustrating an optimum position of the sound collection microphone 201.

In the present embodiment, as illustrated in FIGS. 7A and 7C, in a case of the end binding in which one end side in the width direction of the original document is bound, the position on the opposite side in the width direction to the binding location bound by the binding tool such as the staple needle S is the optimum position where the deformation sound of the original document can be preferably picked up. Further, as illustrated in FIG. 7B, in a case of two-location binding in which two locations are bound in the width direction of the original document, the center of the original document in the width direction is the optimum position of the sound collection microphone 201. Note that the example illustrated in FIGS. 7A, 7B, and 7C is an example, and in a case of end binding, a position near the binding location in the width direction of the original document may be an optimum position where the deformation sound of the original document can be preferably picked up depending on the configuration of the apparatus and the like. The optimum position of the sound collection microphone 201 in the width direction can be obtained by an experiment or the like.

Figure 8A:
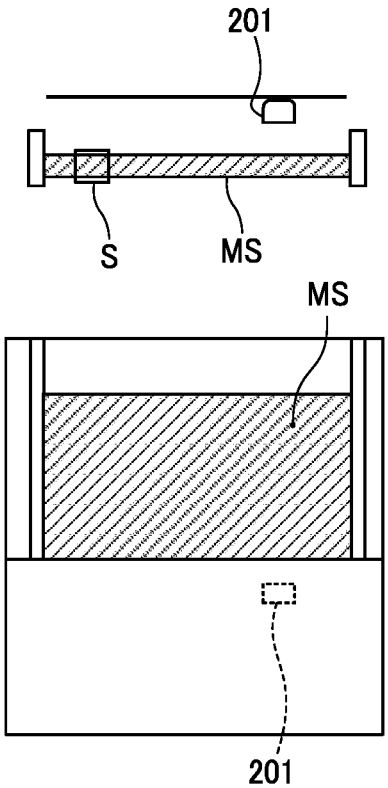
FIGS. 8A and 8B are views each illustrating a relation of the width size of an original document and the optimum position of a sound collection microphone.
Figure 8B:
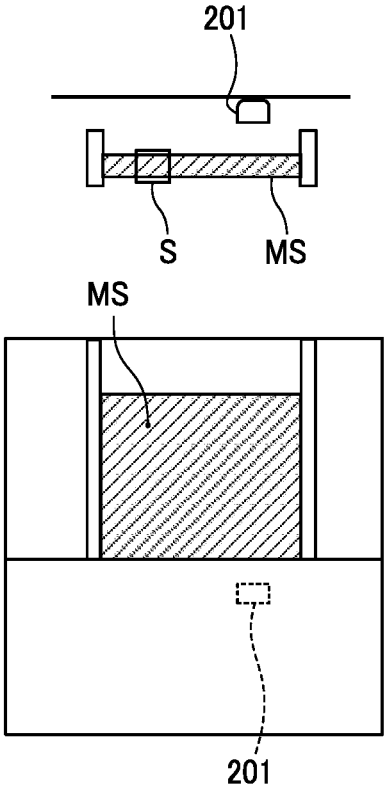

FIGS. 8A and 8B are views each illustrating a relation of the width size of an original document and the optimum position of the sound collection microphone 201.

In a case where the optimum position of the sound collection microphone 201 at the time of the end binding in which one end side in the width direction of the original document is bound is a position on the opposite side in the width direction to the binding location by the binding tool such as the staple needle S, as illustrated in FIGS. 8A and 8B, the optimum position of the sound collection microphone 201 differs depending on the width size of the original document. More specifically, when an original document has a narrow width size illustrated in FIG. 8B, the optimum position of the sound collection microphone 201 is closer to the center in the width direction than when an original document has a wide width size illustrated in FIG. 8A.

Figure 9A:
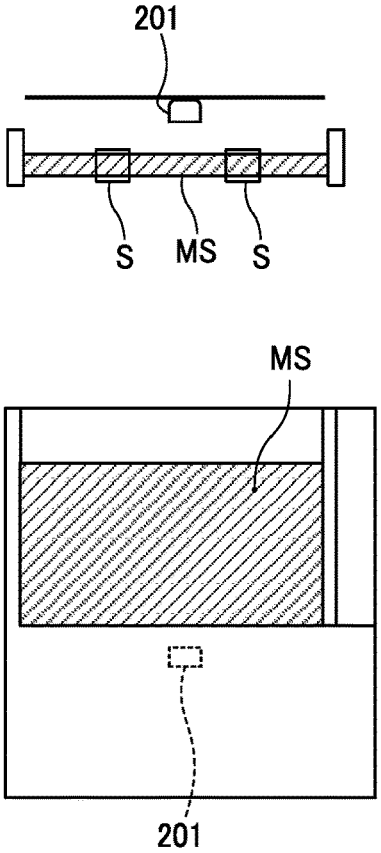
FIGS. 9A and 9B are views each illustrating a relation of the width size of an original document and the optimum position of a sound collection microphone when the conveyance reference of the original document is at one end side in the width direction of the device.
Figure 9B:
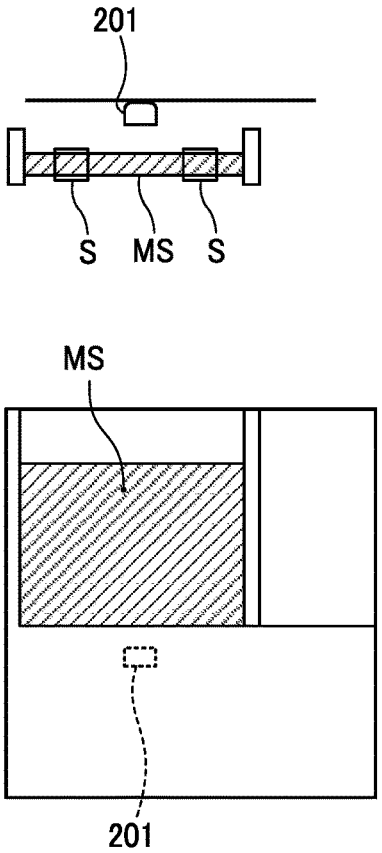

FIGS. 9A and 9B are views each illustrating a relation of the width size of an original document and the optimum position of the sound collection microphone 201 in a case where the conveyance reference of the original document is one end side in the width direction of the device.

The optimum position of the sound collection microphone 201 at the time of two-location binding in which two locations in the width direction of the original document are bound is the center of the original document in the width direction. When the conveyance reference of the original document is one end side in the width direction (left side in the drawing) of the device, a position facing the center of the original document in the width direction differs in the width direction of the device depending on the width size of the original document. Specifically, as illustrated in FIG. 9B, when an original document has a narrow width size, a position facing the center of the original document in the width direction is on the left side in the drawing as compared when the width size is wide as illustrated in FIG. 9A.

Note that, in a case where binding information such as a binding position and a binding method of a bound bundle of original documents that may be conveyed is not available in advance, the center of the original document to be conveyed in the width direction is the optimum position of the sound collection microphone 201.

As described above, the optimum position of the sound collection microphone 201 that can preferably pick up the original document deformation sound differs in the width direction depending on the width size and the binding method of the original document.

Therefore, in the present embodiment, the sound collection microphone 201 is movable in the width direction, and the sound collection microphone 201 can be positioned at an optimum position where the original document deformation sound can be preferably picked up. Features of the present embodiment will be described below with reference to the drawings.

Figure 10:
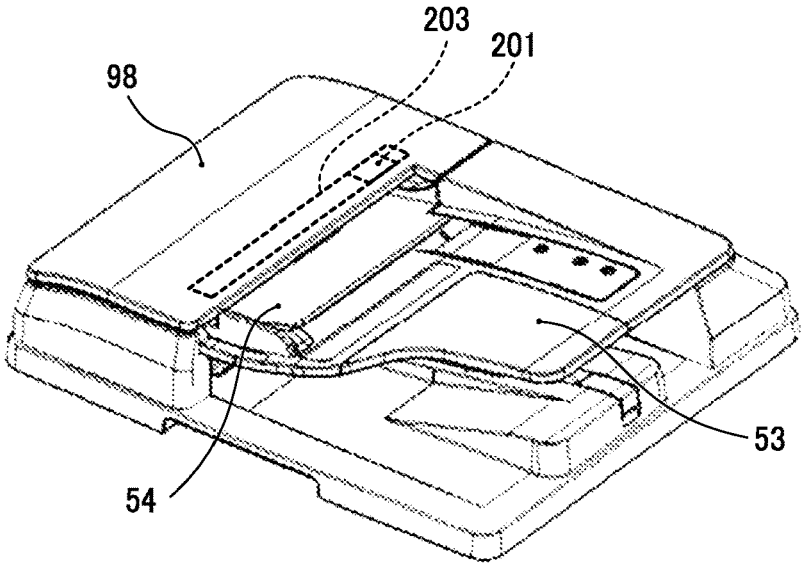
FIG. 10 is a perspective view of the ADF.
Figure 11:
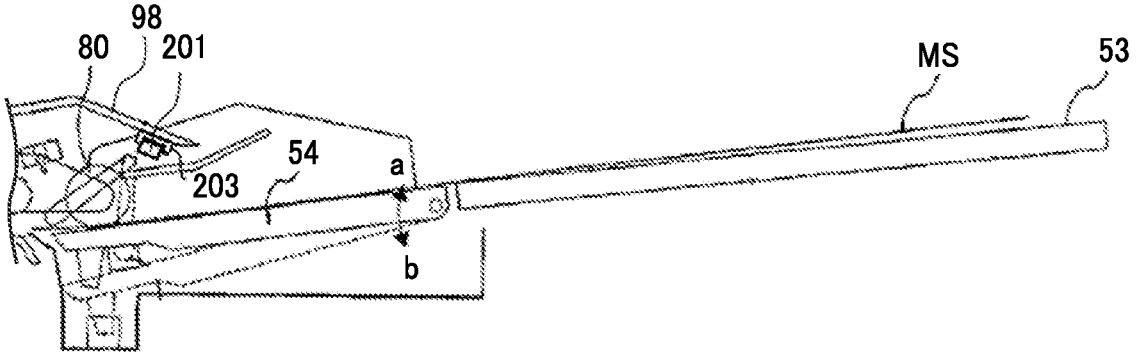
FIG. 11 is a view illustrating the disposition of the sound collection microphone.

FIG. 10 is a perspective view of the ADF 51. FIG. 11 is a view illustrating the disposition of the sound collection microphone 201.

The sound collection microphone 201 is held movably in the width direction of the original document by a guide rail 203 attached to the inner peripheral surface of the sheet feeding cover 98. As the sound collection microphone 201 are disposed on the inner circumferential face of the sheet feeding cover 98, noise from outside can be shielded by the sheet feeding cover 98 and the sound collection microphone 201 are made difficult to pick up noise from outside.

The leading end of the bound bundle of original documents enters the separation portion, and deformation such as folds or wrinkles of the original documents caused by the stress at the bound location occurs on the upstream side of the separation portion in the conveyance direction of the original document. Therefore, in the present embodiment, the sound collection microphone 201 is disposed on the upstream side of the original document conveyance with respect to the separation portion. As a result, the sound in the region on the upstream side of the separation portion can be collected preferably, and the deformation sound of the original document generated on the upstream side of the separation portion can be collected preferably.

Note that the arrangement position of the sound collection microphone 201 is not limited to this, and the sound collection microphone 201 may be appropriately arranged at a location where a member for blocking the deformation sound of the original document generated on the upstream side of the separation portion is not provided and the sound in the region on the upstream side of the separation portion can be collected preferably.

Figure 12A:
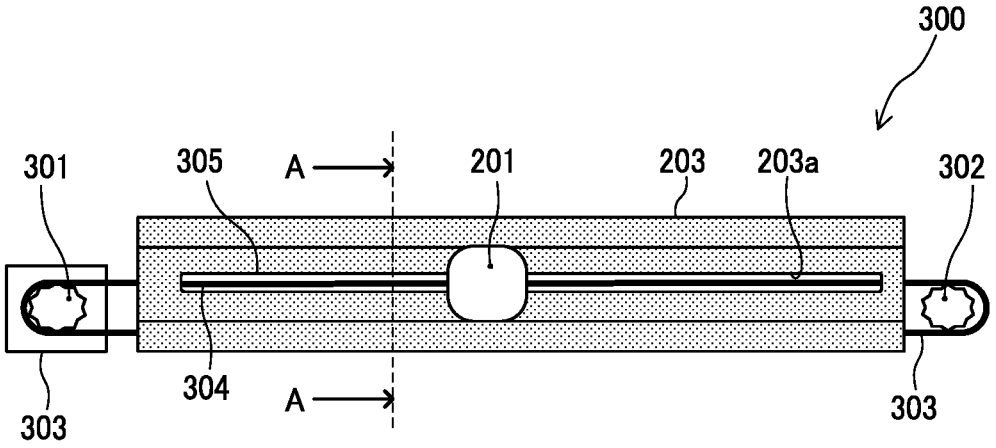
FIGS. 12A and 12B are schematic views each illustrating a configuration of a moving mechanism that moves the sound collection microphone in the width direction of the original document.
Figure 12B:
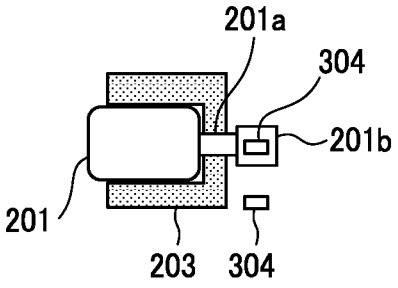

FIGS. 12A and 12B are schematic views each illustrating a configuration of a moving mechanism 300 that moves the sound collection microphone 201 in the width direction of the original document. FIG. 12A is a schematic configuration view of the moving mechanism 300 as viewed from below (original document conveyance path side), and FIG. 12B is a cross-sectional view taken along line A-A of FIG. 12A.

The guide rail 203 has a recessed shape, and the sound collection microphone 201 is held in the guide rail 203. A long hole 203*a* extending in the width direction of the original document is provided at the bottom of the guide rail 203.

As illustrated in FIG. 12B, a shaft portion 201*a* is provided on the side opposite to the sound collecting side of the sound collection microphone 201, and the shaft portion 201*a* penetrates the long hole 203*a* of the guide rail 203.

The moving mechanism 300 includes a sound collection microphone moving motor 303 and a timing belt 304. The sound collection microphone moving motor 303 is disposed on one end side in the width direction (the left side in FIG. 9A) of the guide rail 203. The timing belt 304 is stretched between a drive pulley 301 attached to a motor shaft of the sound collection microphone moving motor 303 and a driven pulley 302 disposed on the other end side in the width direction of the guide rail 203 (the right side in FIG. 9A).

A fixing portion 201*b* is provided at the leading end of the shaft portion 201*a* of the sound collection microphone 201, and the fixing portion 201*b* is fixed to the timing belt 304.

When the timing belt 304 stretched between the drive pulley 301 and the driven pulley 302 is rotationally driven by the sound collection microphone moving motor 303, the sound collection microphone 201 moves in the width direction of the original document while being guided by the guide rail 203.

Figure 13:
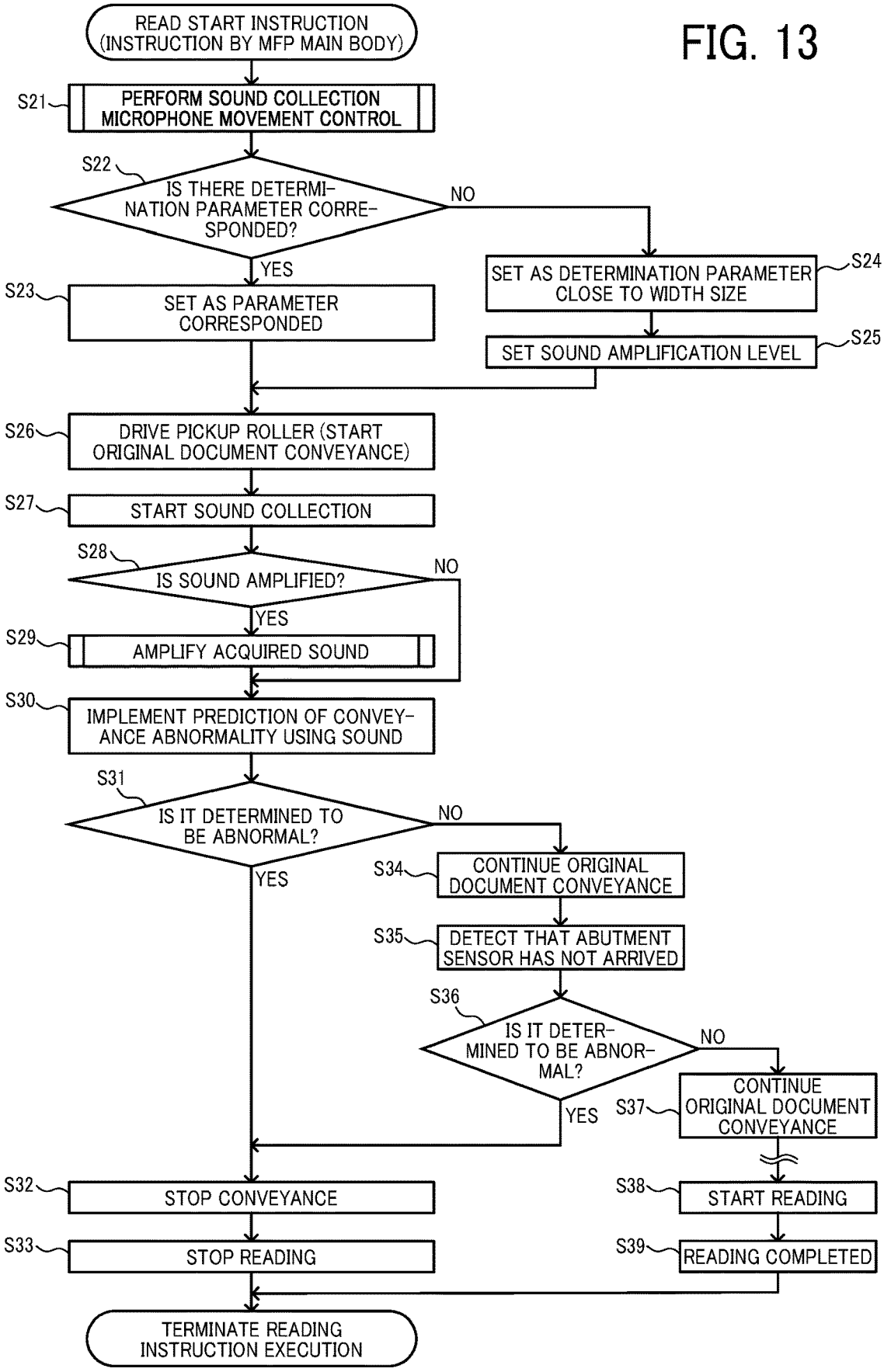
FIG. 13 is a flowchart of an abnormal conveyance determination process.

FIG. 13 is a flowchart of an abnormal conveyance determination process executed by the controller 904.

First, the controller 904 receives the original document sheet feeding signal from the apparatus controller 901, and performs sound collection microphone movement control when an instruction to start reading is given (S21).

Figure 14:
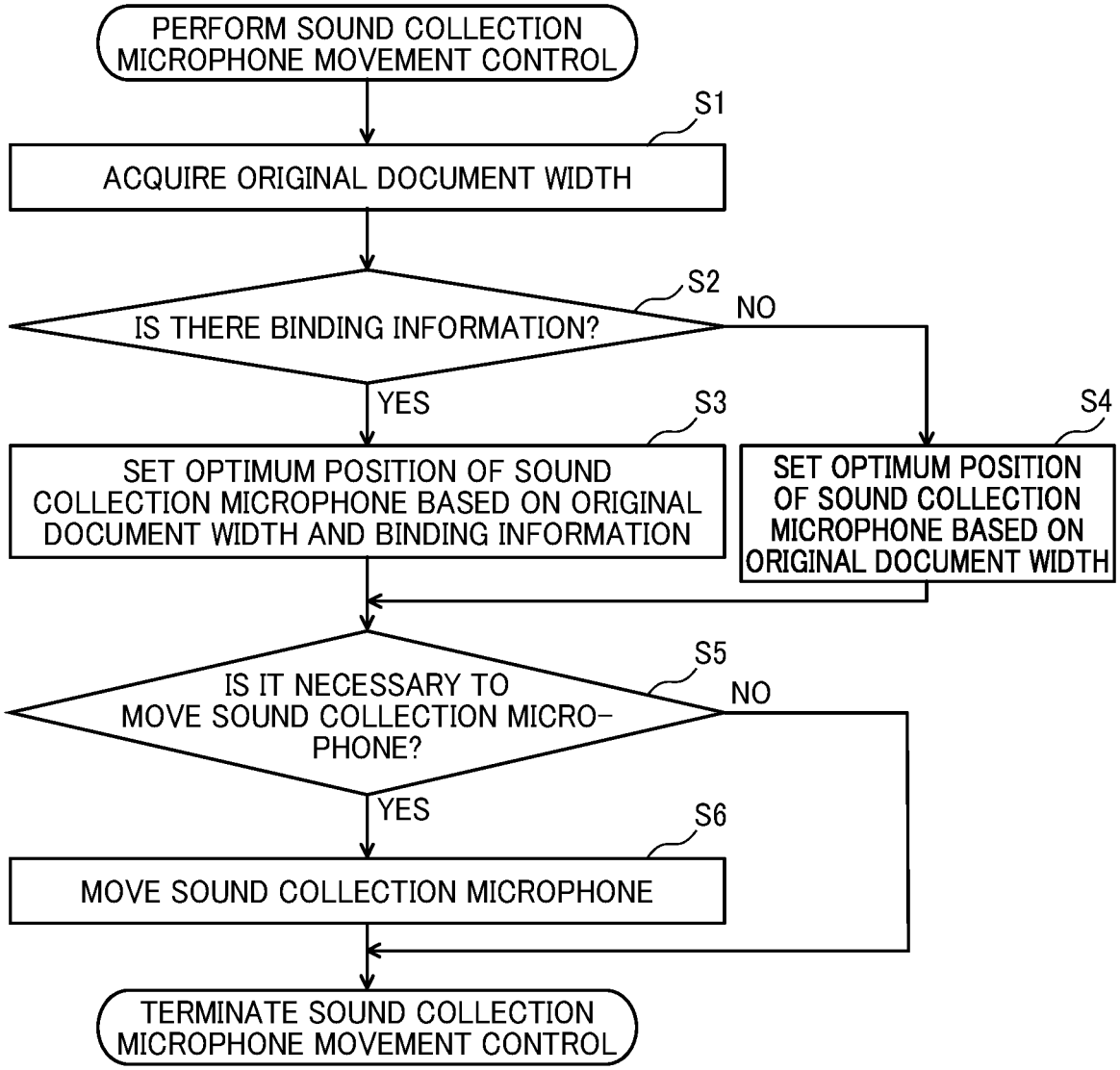
FIG. 14 is a flowchart of a sound collection microphone movement control.

FIG. 14 is a flowchart of a sound collection microphone movement control.

When the sound collection microphone movement control is performed, the controller 904 acquires the width size of the original document set on the original document loading tray 53 as illustrated in FIG. 14 (S1). For example, a unit for detecting the position of the side fence in the document width direction is provided, and the width size of the original document set on the original document loading tray 53 is acquired from the width direction position of the side fence. Further, the user may input the width size of the original document by operating the apparatus control panel 902, and the width size of the original document set on the original document loading tray 53 may be acquired from the input result (size specifying information).

Next, when the user sets an original document, the controller 904 confirms whether there is binding information of the original document as designation information designated by operating the apparatus control panel 902.

Figure 15:
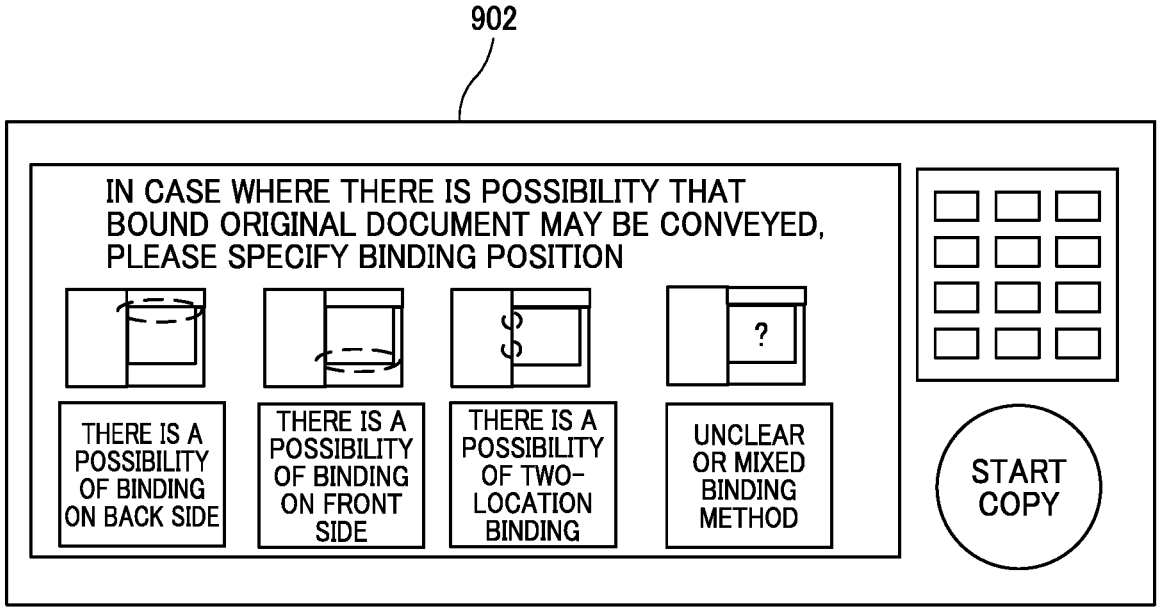
FIG. 15 is a view illustrating an example of a binding information input screen displayed on a main apparatus control panel.

FIG. 15 is a view illustrating an example of a binding information input screen displayed on the apparatus control panel 902 and on which the user inputs binding information.

The user operates the apparatus control panel 902 to display a binding information input screen as illustrated in FIG. 15 when there is a possibility that a bound bundle of original documents is conveyed, for example, when there is a possibility that a binding tool such as a staple needle or a clip is left in a bundle of original documents to be set on the original document loading tray 53.

Then, a binding position and a binding method (two-location binding, end binding, or the like) of a bundle of original documents that may be conveyed are designated from the binding information input screen.

When the user inputs the binding information, the apparatus controller 901 transmits the binding information to the controller 904 together with the original document sheet feeding signal.

As illustrated in FIG. 14, when the binding information as the designation information is not received from the apparatus controller 901 (No in S2), the controller 904 sets the position facing the center of the original document in the width direction as the optimum position based on the acquired original document width size (S4).

On the other hand, when the binding information is received from the apparatus controller 901 (Yes in S2), the optimum position is set based on the acquired original document width size and the received binding information (S3). For example, when the user designates "there is a possibility of binding on the back side" illustrated in FIG. 15, the position of the front side end portion of the original document is specified based on the original document width size. Then, the position of the specified front side end portion of the original document is set as the optimum position of the sound collection microphone (see FIG. 7A). Note that, in a case where the conveyance reference of the original document is the front side end portion of the device, it is not necessary to specify the position of the front side end portion of the original document based on the original document width size.

Further, when the user selects "there is a possibility of binding on the front side" illustrated in FIG. 15, the position of the back side end portion of the device of the original document is specified based on the width size. Then, the position of the back side end portion of the device of the original document specified is set as the optimum position of the sound collection microphone (see FIG. 7C). Note that, in a case where the conveyance reference of the original document is the back side end portion of the device, it is not necessary to specify the position of the back side end portion of the device of the original document by the original document width size.

When the user selects "there is a possibility of two-location binding" illustrated in FIG. 15 or selects "unclear or mixed binding methods", the position of the center of the original document in the width direction is specified based on the original document width size. Then, the specified position of the center of the original document in the width direction is set as the optimum position of the sound collection microphone (see FIG. 7B). Note that, in a case where the conveyance reference of the original document is the center in the width direction, it is not necessary to specify the position of the center of the original document in the width direction by the width size.

In this manner, when the setting of the optimum position is completed, the controller 904 determines whether or not it is necessary to move the sound collection microphone 201. Specifically, the non-volatile memory of the controller 904 stores the optimum position information at the time of the previous original document conveyance, and calculates a difference between the previous optimum position and the optimum position set this time. When the difference value is 0, it is not necessary to move the sound collection microphone 201 (No in S5), and the movement control of the sound collection microphone 201 is terminated.

On the other hand, in a case where the difference value is not 0, it is determined that the sound collection microphone 201 is necessary to be moved (Yes in S5), and the sound collection microphone 201 is moved to the optimum position set this time based on the calculated difference value.

For example, the controller 904 sets the drive time of the sound collection microphone moving motor 303 based on the calculated difference value, and drives the sound collection microphone moving motor 303 for the set drive time to move the sound collection microphone 201 to the optimum position.

In a case where the sound collection microphone moving motor 303 is a stepping motor, the number of steps may be set based on the calculated difference value. Further, the encoder sensor is provided in the sound collection microphone 201, and an encoder scale extending in the width direction of the original document is provided in the sheet feeding cover 98 in such a manner of facing the encoder sensor. Then, the number of pulses of the encoder sensor may be set based on the calculated difference value.

Then, when the sound collection microphone 201 moves to the optimum position, the sound collection microphone movement control is terminated.

When the sound collection microphone movement control is terminated, determination parameters (inverse matrix R-1 and threshold value Th) used for the abnormal conveyance determination are set (S22 to S25 in FIG. 13). In the present embodiment, the sound collection microphone 201 is located at one of the three positions (one end side, center, and other end side in the width direction of the original document) illustrated in FIGS. 7A to 7C for one original document width size. Operation sounds during normal conveyance collected by the sound collection microphone in a case where the sound collection microphone is located at the position of FIG. 7A, operation sounds during normal conveyance collected by the sound collection microphone in a case where the sound collection microphone is located at the position of FIG. 7B, and operation sounds during normal conveyance collected by the sound collection microphone in a case where the sound collection microphone is located at the position of FIG. 7C are different from each other. Therefore, the inverse matrix R-1 obtained from the unit space data set (reference data set) created based on the feature amount obtained from the operation sound in which the original document MS is normally conveyed is different from each other at the three sound collection microphone positions (one end side, center, and other end side in the width direction of the original document) illustrated in FIGS. 7A, 7B, and 7C. Therefore, three inverse matrices R-1 are necessary for at least one original document width size.

The threshold Th is also set using operation sounds of a plurality of conveyance abnormalities collected by the sound collection microphone 201 and operation sounds during a plurality of normal conveyance. Therefore, similarly to the inverse matrix R-1, the threshold Th is also different among the three sound collection microphone positions illustrated in FIGS. 7A, 7B, and 7C. Therefore, three threshold values Th are necessary for at least one original document width size.

However, the determination parameter (inverse matrix R-1 and threshold value Th) used for the abnormal conveyance determination cannot be prepared for all the original document width sizes to be conveyed. Therefore, in the present embodiment, in a case where there is no determination parameter corresponding to the width size of the original document, the abnormality determination is performed by substituting (hereinafter, referred to as a substitute determination parameter) a determination parameter (inverse matrix R-1 and threshold value Th) close to the original document width size.

As illustrated in FIG. 13, in the setting of the determination parameter (inverse matrix R-1 and threshold value Th) used for the abnormal conveyance determination, first, it is confirmed whether the determination parameter (inverse matrix R-1 and threshold value Th) corresponding to the width size of the original document is in the nonvolatile memory of the paper jam predictor 202 (S22).

In a case where the non-volatile memory has the determination parameter (inverse matrix R-1 and threshold value Th) corresponding to the width size of the original document (Yes in S22), the determination parameter (inverse matrix R-1 and threshold value Th) corresponding to the set optimum position of the sound collection microphone among the three determination parameters (corresponding to one end side, corresponding to center, corresponding to other end side in the width direction of the original document) corresponding to the original document width size is set as the parameter for the abnormal conveyance determination.

On the other hand, in a case where there is no determination parameter (inverse matrix R-1 and threshold value Th) corresponding to the original document width size (No in S22), the determination parameter (inverse matrix R-1 and threshold value Th) corresponding to the position closest to the set optimum position of the sound collection microphone is set as the substitute determination parameter from the three determination parameters corresponding to the original document width size close to the set width size of the original document. For example, in a case where the set optimum position of the sound collection microphone is the center in the width direction, the determination parameter corresponding to the center in the width direction in the original document width size close to the set width size of the original document among the three determination parameters corresponding to the original document width size close to the set width size of the original document is the determination parameter corresponding to the position closest to the set optimum position of the sound collection microphone.

The position of the sound collection microphone in the width direction this time positioned by the sound collection microphone movement control illustrated in FIG. 14 is different from the position of the sound collection microphone in the width direction when obtaining the substitute determination parameter to be used this time.

Specifically, the position of the sound collection microphone this time is an optimum position where the original document deformation sound can be preferably picked up in the set original document width size to be conveyed this time. On the other hand, the position of the sound collection microphone in the width direction when obtaining the substitute determination parameter is an optimum position where the original document deformation sound can be preferably picked up in the original document width size close to the set width size of the original document. The position of the sound collection microphone this time and the position of the sound collection microphone when obtaining the substitute determination parameter are respectively optimal positions where the original document deformation sound can be preferably picked up with respect to the corresponding original document width size, but the sound levels of the original document deformation sound to be collected may be different from each other.

In a case where the sound level of the original document deformation sound at the position of the sound collection microphone this time is lower than the sound level of the original document deformation sound at the position of the sound collection microphone when obtaining the substitute determination parameter, the following disadvantage occurs. That is, there is a possibility that even though the bound bundle of original documents is conveyed and the abnormal conveyance occurs, the Mahalanobis distance becomes equal to or less than the threshold Th, and the conveyance is erroneously determined as a normal conveyance. Therefore, in the present embodiment, in a case where the substitute determination parameter is set, the amplification level for amplifying the collected sound is set (S25).

The amplification level of the sound is determined based on, for example, the distance between the position of the sound collection microphone this time and the position of the sound collection microphone when obtaining the substitute determination parameter (the inverse matrix R-1 or the threshold Th). As a result, an optimum amplification level can be set, and the sound level of the original document deformation sound this time can preferably approach to the sound level of the original document deformation sound at a time of the original document width size of the substitute determination parameter. Note that, in a case where the sound level of the original document deformation sound at the position of the sound collection microphone this time is higher than the sound level of the original document deformation sound at the position of the sound collection microphone when obtaining the substitute determination parameter, the collected sound is used as it is. This is because when the sound level of the original document deformation sound is high, it is easy to distinguish between the original document deformation sound and other sounds, and the abnormal conveyance can be determined preferably. In a case where the sound level of the original document deformation sound at the position of the sound collection microphone this time is higher than the sound level of the original document deformation sound at the position of the sound collection microphone when obtaining the substitute determination parameter, the collected sound may be attenuated. By the attenuation, it is possible to suppress erroneous determination that conveyance is abnormal despite normal conveyance.

After setting the amplification level, the controller 904 rotationally drives the pickup roller 80 by the forward rotation of the sheet feeding motor 76. Then, the original document MS on the movable original document table 53*a* is sent out from the movable original document table 53*a*, and a document conveyance is started (S26). Simultaneously with the start of the original document conveyance, the sound collection microphone 201 starts collecting operation sounds (S27).

The sound collection by the sound collection microphone 201 stops the sound collection at a timing when only the uppermost original document MS starts to be separated from several original documents by the separation portion. Specifically, the sound collection is stopped at a timing when the leading end of the original document MS passes through the separation portion at a position slightly downstream from the separation portion. As a result, it is possible to collect sound at the beginning of occurrence of deformation such as wrinkles and folds on the original document, and it is possible to stop conveyance of the original document before major damage such as tear occurs on the original document.

The sound signal of the collected operation sound is converted into pulse code modulation (PCM) data by an analog to digital (AD) converter in the paper jam predictor 202 (see FIG. 6). When the substitute determination parameter is set and the amplification level is set (Yes in S28), the acquired sound signal is amplified according to the set amplification level, then converted into PCM data by the AD converter, and temporarily stored in the RAM of the paper jam predictor 202. On the other hand, when the amplification level is not set (No in S28), the sound signal of the collected operation sound is directly converted into PCM data by the AD converter and temporarily stored in the RAM of the paper jam predictor 202.

The controller 903 (circuitry) is further configured to: find a determination parameter from the determination parameters corresponding to the position of the sound collector in the width direction; set a determination parameter corresponding to a position closest to the position of the sound collector in the width direction when the determination parameter corresponding to the position of the sound collector in the sheet width direction is not found; amplifies the sound collected by the sound collector; and determine whether the abnormal conveyance occurs based on the sound amplified.

The paper jam predictor 202 determines whether an abnormal conveyance occurs based on the operation sounds temporarily stored in the RAM (step S30).

The paper jam predictor 202 then calculates the feature amount of the operation sound stored in the RAM (S5). Specifically, the sound signal stored in the RAM is multiplied by shifting the window function to be segmented into a frame having a predetermined length, and short-time Fourier transform (STFT) is performed to calculate the time array of the power spectrum of the sound signal. The controller 904 then perform a characterization process on the time array of the calculated power spectrum to calculate the feature amount of the operation sound. The characterization process may include, for example, time integration of power in a predetermined frequency band and spectral flux between successive frames. In other words, in the present embodiment, the paper jam predictor 202 serves as a feature amount extraction unit. The feature amount that quantitatively describes the feature of the operation sound used for determining the operation condition is not limited to the above-described feature. For example, the feature amount may include known sound feature amounts such as Mel-Frequency Cepstral Coefficients.

After calculating the feature amount, the paper jam predictor 202 calculates the Mahalanobis distance using the calculated feature amount and the inverse matrix R-1 as the set determination parameter. Then, the paper jam predictor 202 determines the abnormal conveyance using the calculated Mahalanobis distance and the threshold Th. The paper jam predictor 202 determines that the conveyance is a normal conveyance in a case where the calculated Mahalanobis distance exceeds the threshold Th. In contrast, the paper jam predictor 202 determines that the conveyance is an abnormal conveyance in a case where the calculated Mahalanobis distance is equal to or lower than the threshold Th. The paper jam predictor 202 transmits the determination result to the controller 904.

When the determination result of the abnormal conveyance is received from the paper jam predictor 202 (Yes in S31), the controller 904 stops the original document conveyance (S32) and stops the reading operation (S33). Then, the controller 904 sends the result as a reading error to the apparatus control panel 902 of the image forming device 1 to display a message to, for example, prompt a paper jam handling.

On the other hand, when the determination result of the normal conveyance is received from the paper jam predictor 202 (No in S31), the controller 904 continues the original document conveyance (S34). Then, when the abutment sensor 72 does not detect the leading end of the original document MS by the predetermined time (Yes in S36), the controller 904 determines that the abnormal conveyance has occurred in the original document separating and feeding part B. When it is determined that the abnormal conveyance (sheet paper jam) has occurred, the original document conveyance is stopped (S32), and the reading operation is stopped (S33). Then, the controller 904 sends the result as a reading error to the apparatus control panel 902 of the image forming device 1 to display the message to prompt the paper jam handling.

On the other hand, when the abutment sensor 72 detects the leading end of the original document MS by the predetermined time (No in S36), the controller 904 continues the original document conveyance (S37). Specifically, as described above, the sheet feeding motor 191 is reversed, and the pullout operation is performed in which the pullout drive roller 87 sends out the skew-corrected original document. Then, a temporary stop process of temporarily stopping the conveyance of the original document MS is performed before the first reading and conveying part E. Then, the controller 904 waits for a reading start signal to be sent from the scanner controller 903. Then, when the reading start signal is received and the reading is started (S38), the conveyance of the original document is restarted, the original document is conveyed by the first reading and conveying part E and the second reading and conveying part F, and an image of the original document is read. Then, the original document is conveyed to the sheet ejection unit G, the original document is ejected to the sheet ejection tray, and the reading is completed (S39).

In the present embodiment, the abnormal conveyance determination is executed using the MT method. However, the abnormal conveyance determination may be executed by classifying the feature amounts of the operation sounds into a normal conveyance and an abnormal conveyance through machine learning of, for example, support-vector machines. The nonvolatile memory of the paper jam predictor 202 stores learned models as a plurality of determination parameters corresponding to the position of the sound collection microphone 201 in the width direction. Each learned model is obtained by performing machine learning based on a plurality of pieces of learning data including a feature amount calculated from an operation sound collected at each optimum position of the sound collection microphone 201 and correct answer data (normal conveyance/abnormal conveyance). The corresponding learned model is read from the ROM based on the width size of the original document and the width direction position (one end side, center, and other end side in the width direction of the original document) of the microphone, the calculated feature amount is classified into a normal conveyance and an abnormal conveyance using the read learned model, and the abnormal conveyance is determined.

In the above description, the sound collection microphone 201 is automatically moved in the width direction by the sound collection microphone moving motor 303, but the sound collection microphone 201 may be manually moved in the width direction.

Figure 16A:
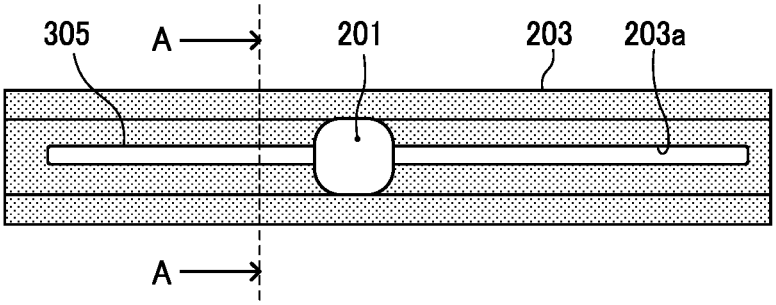
FIGS. 16A and 16B are schematic views each illustrating a configuration that manually moves a sound collection microphone in the width direction.
Figure 16B:
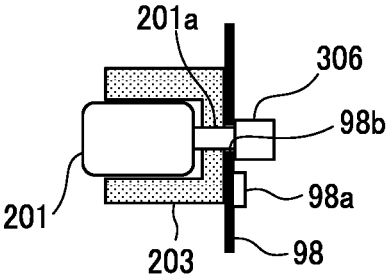

FIGS. 16A and 16B are schematic views each illustrating a configuration that manually moves the sound collection microphone 201 in the width direction.

As illustrated in FIG. 16B, the sheet feeding cover 98 is provided with a through hole 98*b* that is long in the width direction and overlaps the long hole 203*a* of the guide rail 203. A shaft portion 201*a* penetrating the long hole 203*a* of the guide rail of the sound collection microphone also penetrates the through hole 98*b* of the sheet feeding cover 98. A knob portion 306 which is gripped by a user when the user moves the sound collection microphone 201 in the width direction is provided at a leading end of the shaft portion 201*a* which penetrates the through hole 98*b* of the sheet feeding cover 98 and is exposed to the outside. Further, a scale 98*a* such as a scale is disposed near the through hole 98*b* of the sheet feeding cover 98.

In a case of the configuration illustrated in FIGS. 16A and 16B, when it is necessary to move the sound collection microphone 201 to the optimum position, a display prompting the apparatus control panel 902 to move the sound collection microphone 201 is performed, and the optimum position (scale indicated by the scale 98*a*) of the sound collection microphone 201 is displayed based on the set original document width. The user grips the knob portion 306 and moves the sound collection microphone in the width direction so that the sound collection microphone is positioned at the optimum position (scale) displayed on the apparatus control panel 902.

Note that a sound collection microphone as a sound collector is disposed in at least one of the plurality of conveyance units including the registration part C, the turn part D, the first reading and conveying part E, the second reading and conveying part F, and the sheet ejection unit G. Then, sound collection may be performed when the original document passes near the sound collection microphone, and the abnormal conveyance in the conveyance unit may be determined based on the collected sound. Then, by making the sound collection microphone movable in the width direction, it is possible to position the sound collection microphone at an optimum position according to the width of the original document, the sheet thickness of the original document, and the like and at which can preferably pick up the sound generated when the paper jam occurs in the conveyance unit. As a result, it is possible to preferably determine whether or not the paper jam occurs in the conveyance unit from the sound collected by the sound collection microphone.

In the above description, an example in which the present embodiment is applied to the ADF 51 as the sheet conveying device has been described. However, the present embodiment may be applied to a conveying device that conveys a transfer sheet of the image forming device 1. For example, the sound collection microphone is disposed in such a manner that the sound collection microphone can collect sound at a predetermined position in a region from the feed roller 43 to the conveyance roller 46 and a region from the feed roller 43 to the registration roller pair 33 functioning as a pullout roller that can be stopped during conveyance of the transfer sheet. Then, by providing the sound collection microphone in such a manner that the sound collection microphone is movable in the width direction of the sheet, the sound collection microphone can be positioned at an optimum position corresponding to the width of the sheet, the type of the sheet, and the like and at which can preferably pick up the sound generated when the paper jam occurs. As a result, it is possible to preferably determine whether or not the paper jam occurs from the sound collected by the sound collection microphone.

Furthermore, the present embodiment can also be applied to the switchback device 36 and a sheet conveying device included in an image forming apparatus using an inkjet.

Although the desirable embodiments and examples of the present embodiment have been described above, the present embodiment is not particularly limited to such specific embodiments and examples unless otherwise particularly limited in the above description, and various modifications and changes can be made without departing from the spirit and scope of the present embodiment as set forth in the appended claims.

The above-described embodiments are limited examples, and the present disclosure includes, for example, the following aspects having advantageous effects.

Aspect 1

According to Aspect 1, a sheet conveying device includes a conveyor such as a pickup roller 80 that conveys a sheet such as an original document, a sound collector such as a sound collection microphone 201 that collects a sound during sheet conveyance, and an abnormal conveyance determination unit such as a paper jam predictor 202 that determines whether an abnormal conveyance occurs based on a sound collected by the sound collector, the sound collector being movable to an arbitrary position in a sheet width direction within a width of the sheet to be conveyed.

For example, as illustrated in FIG. 7B, when a sheet bundle bound at two locations, which are bound at two locations on a leading end side of the sheet at a predetermined interval in the sheet width direction, is conveyed and becomes a paper jam, wrinkles or the like generally occur at a center of the sheet in a width direction, and a deformation sound generates at the center of the sheet width direction.

Therefore, in a case of the sheet bundle bound at two locations, an optimum position of the sound collector that can preferably collect a sound generated when the paper jam such as a sheet deformation sound occurs is a position facing the center of the sheet in the sheet width direction. As described above, depending on a binding method of the sheet and the like, the optimum position of the sound collector that can preferably collect the sound generated when the paper jam occurs may be within a sheet width (region facing a surface of the sheet). However, in Japanese Patent No. 5340463 in which the sound collector is provided on a side fence, the sound collector cannot be positioned within the sheet width, and the sound collector cannot be positioned at the optimum position depending on how the sheets are bound. As a result, there is a possibility that a determination result of an abnormal conveyance has low accuracy.

On the other hand, in Aspect 1, the sound collector can be moved to an arbitrary position in the sheet width direction within the width of the sheet to be conveyed. As a result, when there is a possibility that a bundle of sheets bound at two locations is conveyed, the sound collector can be positioned at a position facing the center in the sheet width direction of the sheet to be conveyed, and when there is a possibility that a bundle of one-side bound sheets bound by stapling is conveyed to any of four corners of the sheet, the sound collector can be positioned at a position facing an end portion in the sheet width direction of the sheet to be conveyed. As a result, as compared with Japanese Patent No. 5340463 in which the sound collector is provided on the side fence, the sound collector can be positioned at a more optimal position, and a highly accurate determination result of the abnormal conveyance can be obtained.

Aspect 2

According to Aspect 2, the sheet conveying device of Aspect 1 includes a sheet width detector that detects a width of the sheet to be conveyed, wherein the sound collector such as the sound collection microphone 201 is moved in the sheet width direction based on the sheet width detected by the sheet width detector.

According to this, as described with reference to FIGS. 8A, 8B, 9A, and 9B, the optimum position where the sound when the paper jam occurs such as the deformation sound of the sheet such as the original document is generated can be preferably picked up differs depending on the sheet width. Therefore, by moving the sound collector such as the sound collection microphone 201 in the sheet width direction based on the sheet width detected by the sheet width detector such as the original document width sensor 73, the sound collector can be positioned at the optimum position where the sound when the paper jam occurs can be preferably picked up. As a result, a highly accurate determination result can be obtained.

Aspect 3

According to Aspect 3, in the sheet conveying device of Aspect 1 or 2, the sheet conveying device allows a user to designate at least one of a binding method and a position where the user may forget to remove a binding tool such as a staple or a clip (see FIG. 15), and the sound collector such as the sound collection microphone 201 is moved in the sheet width direction based on a designation information designated by the user.

According to this, as described with reference to FIGS. 7A to 7C, the position where the sound such as a deformation sound of the original document generated when a sheet bundle is conveyed and the paper jam occurs can be preferably picked up differs depending on the binding position in the width direction of the sheet and the binding method (one-side binding, two-location binding, and the like).

In Aspect 3, the sheet conveying device allows the user to designate at least one of the binding method and the position where the user may forget to remove the binding tool such as the staple, and the sound collector such as the sound collection microphone 201 is moved in the sheet width direction based on a designation information designated by the user. Thus, the sound collection microphone can be positioned at the optimum position according to the binding position and the binding method, and a highly accurate determination result can be obtained.

Aspect 4

According to Aspect 4, the sheet conveying device of Aspect 3 includes a sheet width detector that detects the width of the sheet, wherein the sound collector such as the sound collection microphone 201 is moved in the sheet width direction based on the designation information and the sheet width detected by the sheet width detector.

According to this, as described with reference to FIGS. 8A, 8B, 9A, and 9B, even when the binding method and the binding position are the same, the positions in the width direction at which the sound such as the deformation sound of the original document generated when the sheet bundle is conveyed and the paper jam occurs is preferably picked up differ depending on the width of the sheet.

Therefore, by moving the sound collector such as the sound collection microphone 201 in the sheet width direction based on the designation information and the sheet width detected by the sheet width detector, the sound collection microphone can be positioned at a pointing position where the sound generated when the sheet bundle is conveyed and the paper jam occurs can be preferably picked up, and a highly accurate determination result can be obtained.

Aspect 5

According to Aspect 5, in the sheet conveying device of any one of Aspects 1 to 4, determination parameters (inverse matrix R-1 and threshold Th) for an abnormal conveyance determination unit such as a paper jam predictor 202 to determine whether the abnormal conveyance occurs are switched based on the position of the sound collector in the sheet width direction such as the sound collection microphone 201.

According to this, as described in the embodiment, a highly accurate determination result can be obtained.

Aspect 6

According to Aspect 6, in the sheet conveying device of Aspect 5, when there is no determination parameter corresponding to the position of the sound collector in the sheet width direction such as the sound collection microphone 201, the abnormal conveyance determination unit such as the paper jam predictor 202 uses the determination parameter corresponding to the position closest to the position in the width direction of the sound collector, amplifies the sound collected by the sound collector, and determines whether the abnormal conveyance occurs based on the amplified sound.

According to this, as described in the embodiment, since the sound collector such as the sound collection microphone 201 can be positioned at any position in the width direction, the sound collector can be positioned at the optimum position where the sound such as the deformation sound of the sheet when the paper jam occurs can be preferably picked up even in a case where the sheet having an indefinite size is set. However, the determination parameters (inverse matrix R-1 and the threshold Th) are finite, and there may be no corresponding determination parameter for the indefinite size or the like. At this time, although the determination parameter corresponding to the position closest to the position in the width direction of the sound collector is used, the sound level collected by the sound collector this time when the paper jam occurs may be lower than the sound level such as the deformation sound of the sheet collected by the sound collector when the paper jam occurs used when used when the substitute determination parameters (inverse matrix R-1 and threshold Th) to be used are set. In a case where the sound level collected by the sound collector this time when the paper jam occurs is lower, although the sound is generated when the paper jam occurs, it may be erroneously determined that a conveyance is normal when using the substitute determination parameters (inverse matrix R-1 and threshold Th).

Therefore, in Aspect 6, by amplifying the sound collected by the sound collector, the sound level collected by the sound collector this time when the paper jam occurs can be made equal to or higher than the sound level such as the deformation sound of the sheet collected by the sound collector when the paper jam occurs used when the substitute determination parameters (inverse matrix R-1 and threshold Th) are set. As a result, it is possible to suppress erroneous determination in which it is determined that a normal conveyance is performed although the sound in which the paper jam occurs is generated, and it is possible to improve the accuracy of determination of an abnormal conveyance.

Aspect 7

According to Aspect 7, in the sheet conveying device of Aspect 6, the abnormal conveyance determination unit such as the paper jam predictor 202 amplifies the sound collected by the sound collector based on the distance between the position of the sound collector in the sheet width direction such as the sound collection microphone 201 and the position of the sound collector in the sheet width direction corresponding to the substitute determination parameter used for the determination.

According to this, as described in the embodiment, it is possible to preferably approach the sound level when the paper jam occurs such as the deformation sound of the sheet collected by the sound collector used when the substitute determination parameters (inverse matrix R-1 and threshold Th) are set using the sound level when the paper jam occurs such as the deformation sound of the sheet collected by the sound collector this time. Accordingly, even in a case where the substitute determination parameter is used, it is possible to preferably determine the abnormal conveyance.

Aspect 8

According to Aspect 8, the sheet conveying device of any one of Aspects 1 to 7 includes a feature amount extraction unit such as the paper jam predictor 202 that extracts a feature amount (in the present embodiment, time integration of power in a frequency band, spectral flux between consecutive frames, and the like) of the sound collected by the sound collector such as the sound collection microphone 201, wherein an abnormal conveyance determination unit such as the paper jam predictor 202 determines whether an abnormal conveyance occurs based on the feature amount.

According to this, it is possible to accurately determine the abnormal conveyance.

Aspect 9

According to Aspect 9, an automatic document feeder includes an original document sheet conveyance unit that conveys an original document sheet such as the original document MS, wherein the original document sheet conveyance unit conveys the original document sheet to an image reading unit, and the sheet conveying device of any one of Aspects 1 to 8 is used as the original document sheet conveyance unit.

According to this, it is possible to accurately determine the abnormal conveyance of the original document.

Aspect 10

According to Aspect 10, an image forming apparatus that forms an image on a sheet includes the sheet conveying device according to any one of Aspects 1 to 7, or includes the automatic document feeder such as the ADF 51 according to Aspect 9.

Each of the functions of the described embodiments such as the controller 904 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

According to this, it is possible to accurately determine the abnormal conveyance of the sheet. Thus, according to the present embodiment, it is possible to obtain a highly accurate determination result of an abnormal conveyance.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A sheet conveying device comprising:

a conveyor to convey a sheet in a conveyance direction;

a sound collector to collect sound generated by a conveyance of the sheet by the conveyor, the sound collector movable in a sheet width direction orthogonal to the conveyance direction; and circuitry configured to determine whether an abnormal conveyance occurs based on the sound collected by the sound collector, wherein the circuitry is further configured to switch determination parameters to determine whether an abnormal conveyance occurs based on a position of the sound collector in the sheet width direction.

2. The sheet conveying device according to claim 1, further comprising:

a sheet width detector configured to detect a width of the sheet to be conveyed by the conveyor, a moving mechanism to move the sound collector in the sheet width direction, and circuitry configured to cause the moving mechanism to move the sound collector in the sheet width direction based on the width detected by the sheet width detector.

3. The sheet conveying device according to claim 1, further comprising:

a moving mechanism to move the sound collector in the sheet width direction, and circuitry configured to cause the moving mechanism to move the sound collector in the sheet width direction based on a position of a binder that binds the sheet.

4. The sheet conveying device according to claim 3, further comprising:

a sheet width detector to detect a width of the sheet to be conveyed by the conveyor, wherein the circuitry is further configured to cause the moving mechanism to move the sound collector in the sheet width direction based on:

the position of the binder; and the width detected by the sheet width detector.

5. The sheet conveying device according to claim 1, wherein the circuitry is further configured to:

find a determination parameter from the determination parameters corresponding to the position of the sound collector in the width direction;

set a determination parameter corresponding to a position closest to the position of the sound collector in the sheet width direction when the determination parameter corresponding to the position of the sound collector in the sheet width direction is not found;

amplify the sound collected by the sound collector; and determine whether the abnormal conveyance occurs based on the sound amplified.

6. The sheet conveying device according to claim 5, wherein the circuitry is configured to amplify the sound collected by the sound collector based on:

a distance, in the sheet width direction, between:

the position of the sound collector; and the position closest to the position of the sound collector.

7. The sheet conveying device according to claim 1, wherein the circuitry is further configured to:

extract a feature amount of the sound collected by the sound collector; and determine whether the abnormal conveyance occurs based on the feature amount extracted.

8. An automatic document feeder comprising the sheet conveying device according to claim 1 to convey an original document sheet to an image reading unit to read the original document sheet.

9. An image forming apparatus comprising:

an image forming unit to form an image on a sheet; and the automatic document feeder according to claim 8.

10. An image forming apparatus comprising:

an image forming unit to form an image on a sheet; and the sheet conveying device according to claim 1 to convey the sheet to the image forming unit.

* * * * *